US011596953B2

(12) United States Patent
Jameson

(10) Patent No.: US 11,596,953 B2
(45) **Date of Patent: *Mar. 7, 2023**

(54) SYSTEM, METHOD AND APPARATUS FOR FROTH FLOTATION

(71) Applicant: HUNTER PROCESS TECHNOLOGIES PTY LIMITED, Hornsby (AU)

(72) Inventor: Graeme J. Jameson, Hornsby (AU)

(73) Assignee: HUNTER PROCESS TECHNOLOGIES PTY LIMITED, Hornsby (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/108,257

(22) Filed: Dec. 1, 2020

(65) Prior Publication Data

US 2021/0078018 A1 Mar. 18, 2021

Related U.S. Application Data

(63) Continuation of application No. 16/601,316, filed on Oct. 14, 2019, now Pat. No. 10,850,286, which is a (Continued)

(30) Foreign Application Priority Data

Aug. 28, 2015 (AU) ..... 2015903507
Aug. 24, 2016 (AU) ..... 2016903371

(51) Int. Cl.
*B03D 1/08* (2006.01)
*B03D 1/02* (2006.01)
(Continued)

(52) U.S. Cl.
CPC ..... *B03D 1/247* (2013.01); *B03D 1/028* (2013.01); *B03D 1/08* (2013.01); *B03D 1/1475* (2013.01); *B03D 2203/08* (2013.01)

(58) Field of Classification Search
CPC ..... B03D 1/08; B03D 1/028; B03D 1/247; B03D 1/1475
(Continued)

(56) References Cited

U.S. PATENT DOCUMENTS 2,104,537 A 1/1938 Ellis
4,545,892 A * 10/1985 Cymbalisty ..... B03D 1/1475 261/DIG. 75
(Continued)

FOREIGN PATENT DOCUMENTS

AU 3444984 A 4/1985
WO WO-2004/082842 A1 9/2004
(Continued)

OTHER PUBLICATIONS

Search Report and Written Opinion in International Application No. PCT/AU2016/050806 dated Dec. 8, 2016, 19 pages.
(Continued)

*Primary Examiner* — Terrell H Matthews
(74) *Attorney, Agent, or Firm* — Marshall, Gerstein & Borun LLP

(57) ABSTRACT

A separation system is disclosed for separating selected particles from a mixture of particles in a fluid. The system includes a froth flotation vessel into which in use the mixture of particles and fluid are subjected to an upward flow of an introduced gas to form a froth layer which rises above an interface formed between the froth layer and the mixture of particles and fluid, such that a quantity of the selected particles is conveyed out of the vessel by the froth layer to become a first product of the system. The vessel also has a first outlet arranged in use for receiving a flow of some of the mixture of particles and fluid from the vessel, an entry to the first outlet being located in a region proximate to, but below, the interface. The vessel also has a second outlet arranged in
(Continued)

use for receiving a flow of some of the mixture of particles and fluid from a region of the vessel which is located below the first outlet. In use the first outlet receives a quantity of the selected particles which were not conveyed out of the vessel by the froth layer, and the second outlet receives a quantity of the selected particles in a first by-product of the system. The first by-product comprises a relatively higher percentage of solids compared to the flow of particles and fluid in the first outlet. The flow of the mixture of particles and fluid from the vessel via the first outlet passes to a classification device, which separates the flow into two or more fractions on the basis of their size or density or a combination of the two.

27 Claims, 8 Drawing Sheets

Related U.S. Application Data continuation of application No. 15/755,680, filed as application No. PCT/AU2016/050806 on Aug. 29, 2016, now Pat. No. 10,441,958.

(51) Int. Cl.
*B03D 1/24* (2006.01)
*B03D 1/14* (2006.01)

(58) Field of Classification Search
USPC ..... 209/17
See application file for complete search history.

(56) References Cited

U.S. PATENT DOCUMENTS 5,167,375 A 12/1992 Datta
5,167,798 A * 12/1992 Yoon ..... B01F 25/31421 366/338
5,236,596 A 8/1993 Greenwald, Sr.
5,277,317 A 1/1994 Zlobin et al.
5,467,876 A 11/1995 Hicks et al.
5,591,328 A 1/1997 Bodnaras
5,746,910 A * 5/1998 Negeri ..... B03D 1/16 209/168
5,762,781 A * 6/1998 Bodnaras ..... B03D 1/247 210/220
5,814,210 A * 9/1998 Yoon ..... B03D 1/245 261/122.1
5,923,012 A * 7/1999 Bourke ..... B03D 1/028 209/168
6,056,125 A * 5/2000 Lai ..... B03D 1/1418 209/164
7,318,527 B2 1/2008 Branner
7,624,877 B2 12/2009 Bourke
8,360,245 B2 1/2013 Niitti
9,085,000 B2 * 7/2015 Jameson ..... B03D 1/082
9,278,360 B2 3/2016 Mankosa et al.
10,041,005 B2 8/2018 Van Der Merwe et al.
10,850,286 B2 * 12/2020 Jameson ..... B03D 1/028
2003/0106843 A1 6/2003 Jameson et al.
2008/0308502 A1 12/2008 Jameson
2010/0193408 A1 8/2010 Jameson
2016/0089679 A1 * 3/2016 Prestes ..... B01F 25/4337 209/166

FOREIGN PATENT DOCUMENTS

WO WO-2006081611 A1 * 8/2006 ..... B03D 1/02
WO WO-2006/095044 A1 9/2006
WO WO-2010/006449 A1 1/2010
WO WO-2010006449 A1 * 1/2010 ..... B03D 1/028
WO WO-2011/094842 A1 8/2011
WO WO-2017035580 A1 * 3/2017 ..... B03D 1/028

OTHER PUBLICATIONS

International Preliminary Report on Patentability in International Application No. PCT/AU2016/050806 dated Dec. 1, 2017, 33 pages.
Ata et al., "The Formation of Bubble Clusters in Flotation Cells", Int. J. Miner. Process. 76, 2005, pp. 123-139.
Wills' Mineral Processing Technology, "An Introduction to the Practical Aspects of Ore Treatment and Mineral Recovery", James Finch ed., Elsevier, New York, 2016.

* cited by examiner

SYSTEM, METHOD AND APPARATUS FOR FROTH FLOTATION

CROSS-REFERENCE TO RELATED APPLICATIONS

This application is a continuation of U.S. patent application Ser. No. 16/601,316, filed Oct. 14, 2019, entitled "System, Method and Apparatus for Froth Flotation," which is a continuation of U.S. patent application Ser. No. 15/755,680, filed Feb. 27, 2018, entitled "System, Method and Apparatus for Froth Flotation," which is an application under 35 U.S.C. 371 of international application PCT/AU2016/050806, filed Aug. 29, 2016, which claims priority to Australian patent application 2016903371, filed Aug. 24, 2016 and to Australian patent application 2015903507, filed Aug. 28, 2015, the entire disclosures of which are hereby expressly incorporated by reference herein.

TECHNICAL FIELD

The present disclosure relates to a system, method and apparatus for froth flotation and in particular a system, method and apparatus for a froth flotation process used in the recovery of hydrophobic particles from a mixture. The system, method and apparatus has been developed primarily for improving the recovery of relatively coarse mineral ore particles by froth flotation, and can be configured to deliver multiple concentrate and tails streams, as will be described hereinafter by reference to this application.

BACKGROUND OF THE DISCLOSURE

Froth flotation is used extensively in industry to separate valuable particles from particles of waste material. In the minerals industry for example, rock containing a valuable component is finely ground and suspended in water, to form a pulp or slurry. Reagents are generally added that attach selectively to the valuable particles making them water repellent or non-wetting (hydrophobic), but leaving the unwanted particles in a wettable (hydrophilic) state. The hydrophobic and hydrophilic particles are referred to as mixed particles. In the minerals industry, the valuable particles are often referred to as "values", while the waste material is known as "gangue". Bubbles of air are introduced into the suspension in a vessel or cell. The hydrophobic particles, also referred to as selected particles, attach to the bubbles, and rise with them to the surface of the suspension where a froth layer is formed. The froth flows out of the top of the cell carrying the flotation product. The particles that did not attach to bubbles remain in the liquid and are removed as tailings. Reagents such as frothers may be added, that assist in the creation of a stable froth layer.

The process of adding reagents to the suspension of particles is known as conditioning. Conditioning reagents are usually specific to the particular ore body that is to be treated and the mineral species it contains. The reagents may include a collector, which reacts or adsorbs selectively with the surfaces of the particles to be separated, and a frother, that has the function of stabilizing the bubbles introduced into the system, so that a stable froth layer is formed. Other reagents that may be added, depending on the nature or the ore to be treated, include activators, that assist the collector to adsorb to the particles to be separated, and depressants, that prevent the collector from adsorbing on unwanted minerals.

The formation of a froth layer is an important characteristic of the froth flotation process. In a stable froth layer, froth is discharged over the lip of the flotation cell, being continuously replaced by bubbles with attached particles and entrained particles, from the pulp or slurry in the cell beneath. While moving towards the overflow lip, the froth drains and entrained particles are able to flow back into the pulp, enhancing the purity or grade of the flotation product. The interface between the pulp and the froth is maintained at an appropriate level, so that the froth product can reach the required grade and recovery of particles from the flotation cell.

Machines used in the froth flotation process are known in prior art. A common design consists of an agitator or impeller mounted on a central shaft and immersed in a suitably conditioned pulp in a flotation cell. The rotating impeller creates a turbulent circulating flow within the cell that serves to suspend the particles in the pulp and prevent them from settling in the vessel, to disperse a flow of gas that is introduced into the cell into small bubbles; and to cause the bubbles and particles to come into intimate contact, thereby allowing the hydrophobic particles in the pulp to adhere to the bubbles. The bubbles and attached particles float to the surface of the cell where they form a froth layer that flows over a weir, carrying the flotation product. The impeller customarily is surrounded by a stator that assists in the creation of a highly sheared environment in the vicinity of the impeller, and also prevents the formation of a vortex or whirlpool in the liquid in the cell. Flotation machines of this type, known as mechanical cells, are described in textbooks such as Wills' Mineral Processing Technology, 8th edition, James Finch ed., Elsevier, New York, 2015. Other types of flotation machine, such as column cells, are also described.

It is well known that the recovery of particles in existing flotation devices depends on the size of the particles. For a given floatable species, the recovery of ultrafine particles is very small. With increasing particle size however, the recovery increases until a maximum is reached. With further increases in the particle size, the recovery becomes progressively lower. In base metal flotation, the optimum range for recovery is between 20 and 120 μm in general, although in some cases the upper limit may be slightly increased. Particles above the optimum range are described as coarse particles. For particles of lower density such as coal, the optimum range with current technologies may extend up to 400 μm.

The inability of mechanical cells to recover coarse particles has a detrimental effect on the energy expended in grinding the rock that enters the mill. The grinding energy can be related to the final grind size by an expression known as Bond's Third Law, which can be written:

$$\text{Energy (kW-hr}/t) = 10\ W_i\left(\frac{1}{\sqrt{P_{80}}} - \frac{1}{\sqrt{F_{80}}}\right)$$

where $W_i$ is the Bond Work Index, and $P_{80}$, $F_{80}$ are the 80% passing sizes (μm) of the grinding mill product and the feed to the mill, respectively. The size of the feed material to the mill is typically 150 mm or greater, so the second term in the brackets is negligibly small compared with the first term. It can be appreciated that if the flotation circuit downstream of the mill could process particles that were much larger than those in current practice, there would be significant savings in grinding energy costs and in the costs of the grinding media such as steel balls and mill linings, the two being proportional. For example, if in a mill where the final grind size is currently 100 μm, the final size could be increased to 400 μm, there would be a 50% reduction in grinding energy and media consumption. Since grinding energy is the largest single energy component in a base-metal concentrator, and a very significant cost in the operation of a complete mine-mill complex, a reduction of energy of this magnitude would lead to massive savings for the whole mining enterprise. Accordingly, there is a long-felt need to be able to float coarse particles, to bring about the savings indicated.

Another long-desired feature of froth flotation technology is the ability to process suspensions with a high fraction of solids. The feed to flotation machines in present technologies is generally in the range 5% for coal to 45% solids in base metal flotation. A system that can accept feeds that are just below the packing limit of the solids, typically up to 75% solids for typical ore suspensions, would be highly beneficial, because of the reduction in the process water demand. By increasing the percent solids in the feed, the quantity of recirculated water in the plant will be reduced, as will the demands placed on the downstream thickening and dewatering operations. Furthermore, if the particles are coarser than in current practice, the water lost from the concentrator in the tailings delivered to settling ponds or dams will be considerably reduced. This feature is very important when a concentrator is to be located in a region with limited availability of makeup water.

To mitigate the problem of coarse particle detachment, an invention has recently been disclosed (U.S. Pat. No. 9,085,000), in which flotation is carried out in the relatively calm environment of a fluidised bed. Hydrophobic particles attach to bubbles in the fluidised bed and rise upwardly into a separation zone, in which non-hydrophobic particles detach from the wakes of the rising bubbles and fall back into the fluidised bed, while bubbles with attached hydrophobic particles rise into a froth layer. The froth bubbles flow over a launder lip carrying the hydrophobic particles. Non-hydrophobic particles discharge from the flotation column from the top of the fluidised bed. To maintain the bed in a stable operation, liquid is recycled from a settling zone above the fluidised bed, and returned into the base of the bed.

When a fluidised bed flotation cell is operation, the gas bubbles contact relatively coarse hydrophobic particles in the fluidised bed. The bubble-particle aggregates rise out of the bed and into the separation zone. Many of the relatively finer particles are able to rise upwards to enter the froth zone, discharging over the lip of the containing vessel as a first flotation concentrate. Surprisingly, it has now been observed that not all bubble-particle aggregates have sufficient buoyancy to enter the froth, and they tend to congregate below the froth zone. Given sufficient time, the bubbles coalesce or burst, and the attached particles fall back to the fluidisation zone, or the aggregates may make contact with lightly-loaded bubbles rising in the settling zone, and gain sufficient buoyancy to enter the froth.

SUMMARY OF THE DISCLOSURE

In a first aspect, there is provided a separation system for separating selected particles from a mixture of particles in a fluid, the system comprising: a froth flotation vessel into which in use the mixture of particles and fluid are subjected to an upward flow of an introduced gas to form a froth layer which rises above an interface formed between the froth layer and the mixture of particles and fluid, such that a quantity of the selected particles is conveyed out of the vessel by the froth layer to become a first product of the system; a first outlet arranged in use for receiving a flow of some of the mixture of particles and fluid from the vessel, an entry to the first outlet being located in a region proximate to, but below, the interface; and a second outlet arranged in use for receiving a flow of some of the mixture of particles and fluid from a region of the vessel which is located below the first outlet; wherein the first outlet receives a quantity of the selected particles which were not conveyed out of the vessel by the froth layer; the second outlet receives a quantity of the selected particles in a first by-product of the system; and wherein the first by-product comprises a relatively higher percentage of solids compared to the flow of particles and fluid in the first outlet.

One novel feature of this aspect is the production of two flotation concentrates from the same flotation vessel. It has been discovered that in order to improve the performance of the flotation vessel, it is desirable to collect the bubble-particle aggregates which did not become part of the froth layer, and remove them as soon as they arrive at the top of the separation zone of the flotation vessel, but below the froth interface. These aggregates have a proportionately greater fraction of the relatively coarse hydrophobic particles. The present disclosure provides a means to collect these aggregates and then to use a particle classification system, to separate the relatively coarse particles as a second concentrate, as will hereinafter be described.

A further novel feature of this aspect is the provision of means to control the concentration of solids in a first tailings stream from a froth flotation cell, referred to as the first by-product, which can then be discharged direct to a tailings disposal plant avoiding the need for additional dewatering. In some of the arrangements described herein, a zone of settled solids is created in the base of a fluidised bed, allowing a first tailings stream with a relatively high solids content to be withdrawn from the base of the fluidised bed.

In certain embodiments, the flow of particles in fluid in the first outlet passes to a classification apparatus to produce a flow of relatively coarser particles and a separate flow of relatively finer particles. In certain forms of this, the classification apparatus can be one or more of the group comprising: a screen, a sieve bend, a vibrating screen deck, and a vibratory screen.

Alternatively, in certain embodiments the flow of particles in fluid in the first outlet passes to a classification apparatus to produce a flow of relatively higher density particles, and a separate flow of relatively lower density particles. In certain forms of this, the classification apparatus can be one or more of the group comprising: a hydrocyclone, a spiral, a gravity table, a teeter bed and a reflux classifier.

In certain embodiments, the flow of relatively coarser or of higher density particles includes a concentrated amount of the selected particles, and becomes a second product of the separation system.

In certain embodiments, a control system controls the amount of the said flow of relatively finer particles and/or relatively lower density particles which is directed either to return to the vessel, or to become a second by-product of the separation system. In one form of this, the control system controls a valve which directs the said flows. In another form of this, the control system controls a speed control of a variable speed pump, to direct the amount of the said flows.

In certain embodiments, the control system further includes a sensor which senses the position of the interface in the froth flotation vessel in relation to the first outlet. In one form of this, the sensor is a pressure sensor.

In certain embodiments, fresh feed of selected particles in a mixture of particles in a fluid is introduced in-line into the flow of relatively finer particles and/or relatively lower density particles which is directed to the vessel. In such an embodiment, the separation system can be operated in a continuous manner. If no fresh feed is added, the separation system can operate in a batch mode.

In certain embodiments, gas for froth flotation separation is introduced in-line into the flow which is directed to the vessel. In one form of this, the gas can be introduced as a stream of air which becomes broken up in the flow line, for example by an in-line mixer. In another form of this, the gas can be introduced in the form of bubbles, generated by an appropriate sparger or another bubble generator device. In either of these forms, the resulting mixture of gas and mixture of particles in a fluid can be introduced into the lower region of the vessel, through a vertical, downwardly facing duct.

In certain embodiments, the entry to the first outlet is located at a vertical distance below the interface which is equivalent to about a diameter of the vessel at the interface.

In an alternative embodiment, the entry to the first outlet is located at a vertical distance below the interface which is equivalent to between 0.5 D to 1.0 D, where D is a diameter of the vessel at the interface.

In an alternative embodiment, the entry to the first outlet is located at a vertical distance below the interface which is equivalent to between 0.25 D to 0.5 D, where D is a diameter of the vessel at the interface.

In an alternative embodiment, the entry to the first outlet is located at a vertical distance below the interface which is equivalent to between 0.05 D to 0.25 D, where D is a diameter of the vessel at the interface.

In certain embodiments, the froth flotation vessel operates in two zones, a lowermost region of higher particle concentration, and an uppermost region of lower particle concentration.

In certain embodiments, fresh feed of selected particles in a mixture of particles in a fluid combined with a flow gas is introduced via an entry port in the lowermost region to form part of a fluidised bed of particles suspended in liquid, through which bubbles of gas flow upwardly toward the uppermost region.

In certain embodiments, the entry port is spaced apart sufficiently from the second outlet in order that the fresh feed entering the vessel is not placed in immediate fluid communication with the first by-product leaving the vessel.

In one form of this, the entry port is located near a lower part of the fluidised bed in the vessel, and the second outlet is located near an upper part of the fluidised bed. In an alternative form of this, the entry port is arranged to extend midway into the fluidised bed, and the second outlet is located near a lower part of the fluidised bed. In one such arrangement, the entry port is a standpipe which extends into the fluidised bed.

In certain embodiments, fresh feed of selected particles in a mixture of particles in a fluid, and gas for flotation separation, are introduced at separate locations into the uppermost region.

In one form of this, the gas is introduced near a lower part of the uppermost region in the form of bubbles which rise upwardly through the uppermost region to form the froth layer, and the fresh feed is introduced at a relatively higher location in the uppermost region. In a further form of this, the second outlet is located below a bed of particles which forms at a lowermost region of the froth flotation vessel, and which comprises the first by-product.

In certain embodiments, a chamber located within the froth flotation vessel forms a part of the first outlet, the chamber having an entry which is oriented away from the upward flow of introduced gas in the vessel, in use arranged so that said upward flow of gas is separated from the flow of particles and fluid which is received into the first outlet.

In one form of this, the chamber has a conical shape. In one exemplary form, the entry of the conically-shaped chamber has a cross-sectional area which is less than half of the cross-sectional area of the vessel at the interface.

In certain embodiments, an uppermost region of the froth flotation vessel is configured to have a region of lower cross-sectional area compared to the remainder of the froth flotation vessel, thereby crowding the rising froth so as to increase the superficial velocity of the selected particles out of the froth flotation vessel.

In one form of this, the region of lower cross-sectional area is formed by fitting a narrow neck portion to the uppermost region, for the rising froth to flow through. In another form of this, the region of lower cross-sectional area is formed by locating an inverted cone into an opening of the uppermost region, so as to form at least a partial annular gap therearound, for the rising froth to flow through.

In a second aspect, there is provided a separation system for separating selected particles from a mixture of particles in a fluid, the system comprising: a froth flotation vessel into which in use the mixture of particles and fluid are subjected to an upward flow of an introduced gas to form a froth layer which rises above an interface formed between the froth layer and the mixture of particles and fluid, such that a quantity of the selected particles is conveyed out of the vessel by the froth layer to become a first product of the system; and a first outlet arranged in use for receiving a flow of some of the mixture of particles and fluid from the vessel including a quantity of the selected particles which were not conveyed out of the vessel by the froth layer, an entry to the first outlet being located in a region proximate to, but below, the interface; wherein the mixture of particles and fluid received in the first outlet passes to a classification apparatus to produce a flow of a relatively coarser and/or higher density particles which includes a concentrated amount of the selected particles, and becomes a second product of the system.

Some of the novel features and advantages of the first aspect are also applicable to this second aspect, and cross-reference is made thereto.

In certain embodiments, the system further comprises a second outlet arranged in use for receiving a flow of some of the mixture of particles and fluid from a region of the vessel which is located below the first outlet to form a first by-product of the system, wherein the first by-product comprises a relatively higher percentage of solids compared to the flow of particles and fluid in the first outlet.

In certain embodiments, the classification apparatus also produces a flow of relatively finer and/or lower density particles. In certain forms of this, the classification apparatus can be one or more of the group comprising: a screen, a sieve bend, a vibrating screen deck, a vibratory screen, a hydrocyclone, a spiral, a gravity table, a teeter bed and a reflux classifier.

In certain embodiments, a control system controls the amount of the said flow of relatively finer particles and/or relatively lower density particles which is directed either to return to the vessel, or to become a second by-product of the separation system. In one form of this, the control system controls a valve which directs the said flows. In another form of this, the control system controls a speed control of a variable speed pump, to direct the amount of the said flows.

In certain embodiments, the control system further includes a sensor which senses the position of the interface in the froth flotation vessel in relation to the first outlet. In one form of this, the sensor is a pressure sensor.

In certain embodiments, fresh feed of selected particles in a mixture of particles in a fluid is introduced in-line into the flow of relatively finer particles and/or relatively lower density particles which is directed to the vessel.

In one form of this, the gas for froth flotation separation is introduced in-line into the flow which is directed to the vessel. In one form of this, the gas can be introduced as a stream of gas, which becomes broken up in the flow line, for example by an in-line mixer. In another form of this, the gas can be introduced in the form of bubbles, generated by an appropriate sparger or another bubble generator device. In either of these forms, the resulting mixture of gas and mixture of particles in a fluid can be introduced into the lower region of the vessel, through a vertical, downwardly facing duct.

In certain embodiments, the features of the separation system of the second aspect are otherwise as claimed in the first aspect.

In a third aspect, there is provided a separation system for separating selected particles from a mixture of particles in a fluid, the system comprising: a froth flotation vessel into which in use the mixture of particles and fluid are subjected to an upward flow of an introduced gas to form a froth layer which rises above an interface formed between the froth layer and the mixture of particles and fluid, such that a quantity of the selected particles is conveyed out of the vessel by the froth layer to become a first product of the system; and a first outlet arranged in use for receiving a flow of some of the mixture of particles and fluid from the vessel including a quantity of the selected particles which were not conveyed out of the vessel by the froth layer, an entry to the first outlet being located in a region below the interface; wherein the mixture of particles and fluid received in the first outlet passes to a classification apparatus which in use produces: a first flow being of relatively coarser and/or higher density particles, which includes a concentrated amount of the selected particles, as a second product of the system; and a second flow being of relatively finer particles and/or relatively lower density particles, which is either returned to the vessel, or becomes a by-product of the separation system.

Some of the novel features and advantages of the first aspect are also applicable to this third aspect, and cross-reference is made thereto.

In certain embodiments, an entry to the first outlet is located in a region proximate to the interface.

In certain embodiments, the separation system as claimed further comprises a second outlet arranged in use for receiving a flow of some of the mixture of particles and fluid from a region of the vessel which is located below the first outlet, said flow forming a further by-product of the system which comprises a relatively higher percentage of solids compared to the flow of particles and fluid in the first outlet.

In certain embodiments, the classification apparatus is one or more of the group comprising: a screen, a sieve bend, a vibrating screen deck, a vibratory screen, a hydrocyclone, a spiral, a gravity table, a teeter bed and a reflux classifier.

In certain embodiments, a control system controls a valve which directs an amount of the second flow either to return to the vessel, or to become a by-product of the separation system. In certain alternative embodiments, a control system controls a speed control of a variable speed pump which directs an amount of the second flow either to return to the vessel, or to become a by-product of the separation system.

In certain embodiments, the control system further includes a sensor which senses the position of the interface in the froth flotation vessel in relation to the first outlet. In one form of this, the sensor is a pressure sensor.

In certain embodiments, fresh feed of selected particles in a mixture of particles in a fluid is introduced in-line into the flow of relatively finer particles and/or relatively lower density particles which is directed to the vessel. In such an embodiment, the separation system can be operated in a continuous manner. If no fresh feed is added, the separation system can be operated in a batch mode.

In certain embodiments, gas for froth flotation separation is introduced in-line into the flow which is directed to the vessel. In one form of this, the gas can be introduced as a stream of air which becomes broken up in the flow line, for example by an in-line mixer. In another form of this, the gas can be introduced in the form of bubbles, generated by an appropriate sparger or another bubble generator device.

In certain embodiments, the features of the separation system of the third aspect are otherwise as claimed in the first aspect.

In a fourth aspect, there is provided a separation system for separating selected particles from a mixture of particles in a fluid, the system comprising: a froth flotation vessel having an inlet and an outlet, the inlet arranged in use for introducing particles and fluid into the vessel, and the outlet arranged in use for receiving some of the mixture of particles and fluid flowing from the vessel, and the vessel also arranged for receiving an introduced gas, so that in operation: the mixture of particles and fluid in the vessel are subjected to an upward flow of the introduced gas to form a froth layer in which a quantity of the selected particles is conveyed out of the vessel to become a first product of the system; the mixture of particles and fluid located in the vessel segregates into a lowermost region of higher particle concentration, and an uppermost region of lower particle concentration; and wherein the outlet is arranged at or near a lower part of the lowermost region, and located below the inlet(s) for introducing particles and fluid, and/or for introduced gas into the vessel.

Some of the novel features and advantages of the first aspect are also applicable to this fourth aspect, and cross-reference is made thereto.

In certain embodiments, the outlet is located below a bed of particles which forms in use at a lowermost region of the froth flotation vessel, and which comprises a first by-product.

In certain embodiments, fresh feed of selected particles in a mixture of particles in a fluid combined with a flow of gas is introduced via an entry port in the lowermost region to form part of a fluidised bed of particles suspended in liquid, through which bubbles of gas flow upwardly toward the uppermost region. In one form of this, the entry port is spaced apart sufficiently from the outlet in order that the fresh feed entering the vessel is not placed in immediate fluid communication with a first by-product leaving the vessel via the outlet. In one form of this, the entry port is arranged to extend midway into the fluidised bed. In one such arrangement, the entry port is a standpipe.

In certain alternative embodiments, fresh feed of selected particles in a mixture of particles in a fluid, and gas for flotation separation, are introduced at separate locations into the uppermost region. In one form of this, the gas is introduced near a lower part of the uppermost region in the form of bubbles which rise upwardly through the uppermost region to form the froth layer, and the fresh feed is introduced at a relative higher location in the uppermost region. In such an arrangement, the bed of particles which forms in use at a lowermost region of the froth flotation vessel, and which comprises a first by-product, does not form part of a fluidised bed of particles suspended in liquid.

In certain embodiments, the froth layer rises above an interface formed between the froth layer and the mixture of particles and fluid, and a further outlet is arranged in use for receiving a flow of some of the mixture of particles and fluid from the vessel, an entry to the further outlet being located in a region proximate to, but below, the interface, to receive a quantity of the selected particles which were not conveyed out of the vessel by the froth layer.

In certain embodiments, the features of the separation system of the fourth aspect are otherwise as claimed in the first aspect.

In a fifth aspect, there is provided a separation system for separating selected particles from a mixture of particles in a fluid, the system comprising: a froth flotation vessel into which in use the mixture of particles and fluid are subjected to an upward flow of an introduced gas to form a froth layer which rises above an interface formed between the froth layer and the mixture of particles and fluid, such that a quantity of the selected particles is conveyed out of the vessel by the froth layer; a first outlet arranged in use for receiving a flow of some of the mixture of particles and fluid from the vessel including a quantity of the selected particles which were not conveyed out of the vessel by the froth layer, an entry to the first outlet being located in a region below the interface; a second outlet arranged in use for receiving a flow of some of the mixture of particles and fluid from a region of the vessel which is located below the first outlet, the flow comprising a relatively higher percentage of solids compared to the flow of particles and fluid in the first outlet; wherein the froth flotation vessel has a control system for controlling at least one of: the flow of the mixture of particles and fluid passing through the first outlet, so as to maintain the position of the interface in the froth flotation vessel in relation to the first outlet; and the flow of the mixture of particles and fluid passing through the second outlet, so as to maintain the depth of the region of the vessel having relatively higher percentage solids.

Some of the novel features and advantages of the first aspect are also applicable to this fifth aspect, and cross-reference is made thereto.

In certain embodiments, the flow of particles and fluid in the first outlet passes to a classification apparatus to produce a flow of relatively coarser and/or higher density particles and a separate flow of relatively finer and or lower density particles, and the control system is arranged to control one of the said flows from the classification apparatus.

In certain embodiments, the control system is arranged to control the flow of relatively finer and/or lower density particles. In one form of this, the control system controls the amount of the said flow of relatively finer particles and/or relatively lower density particles which is directed either to return to the vessel, or to become a second by-product of the separation system. In one form of this, the control system controls a valve which directs the said flows. In another form of this, the control system controls a speed control of a variable speed pump, to direct the said flows.

In certain embodiments, the control system further includes a sensor which senses the position of the interface in the froth flotation vessel in relation to the first outlet. In one form of this, the sensor is a pressure sensor.

In certain embodiments, the flow of the mixture of particles and fluid passing through the second outlet is controlled by a valve that is actuated by a sensing device. In certain embodiments, the sensing device measures a physical parameter of the flow through the second outlet, to produce a signal to control the valve. In one form of this, the physical parameter includes one or more of the group comprising: the percentage of particulates in the fluid, the density of the particulates, and the mass flowrate of the particulates in the mixture of particulates in fluid.

In certain embodiments, the flow of the mixture of particles and fluid passing through the second outlet forms a first by-product of the separation system.

In certain embodiments, the region of the vessel having relatively higher percentage solids forms a fluidised bed.

In certain embodiments, the entry to the first outlet is located in a region proximate to the interface.

In certain embodiments, the froth layer becomes a first product of the system.

In certain embodiments, the flow of a relatively coarser and/or higher density particles from the classification apparatus includes a concentrated amount of the selected particles, and becomes a second product of the system. In certain forms of this, the classification apparatus is one or more of the group comprising: a screen, a sieve bend, a vibrating screen deck, a vibratory screen, a hydrocyclone, a spiral, a gravity table, a teeter bed and a reflux classifier.

In certain embodiments, fresh feed of selected particles in a mixture of particles in a fluid is introduced in-line into the flow of relatively finer particles and/or relatively lower density particles which is directed to the vessel. In such an embodiment, the separation system can be operated in a continuous manner. If no fresh feed is added, the separation system can operate in a batch mode.

In certain embodiments, gas for froth flotation separation is introduced in-line into the flow which is directed to the vessel. In one form of this, the gas can be introduced as a stream of air which becomes broken up in the flow line, for example by an in-line mixer. In another form of this, the gas can be introduced in the form of bubbles, generated by an appropriate sparger or another bubble generator device. In either of these forms, the resulting mixture of gas and mixture of particles in a fluid can be introduced into the lower region of the vessel, through a vertical, downwardly facing duct.

In certain embodiments, the features of the separation system of the fifth aspect are otherwise as claimed in the first aspect.

In a sixth aspect, there is provided a froth flotation vessel for separating selected particles from a mixture of particles in a fluid, the vessel comprising: a column arranged so that the mixture of particles and fluid are subjected to an upward flow of an introduced gas to form a froth layer at an uppermost end region thereof, in use the froth layer rising above an interface formed between it and the mixture of particles and fluid, so that a quantity of the selected particles is conveyed out of the uppermost region of the column by the froth layer to become a first product; an outlet which extends into the column, in use for conveying a flow of some of the mixture of particles and fluid from the vessel, the outlet including a wide-mouthed chamber, the opening of which is oriented away from the upward flow of introduced gas in the vessel, its widest point also being located in a region proximate to, but below, the interface; and wherein, in use said upward flow of gas is separated from the flow of particles and fluid which is received via the wide-mouthed chamber into the first outlet.

The flotation vessel has features provided to remove slurry from the central portion of said column from a point beneath the level of the froth-slurry interface, into a disengagement chamber with an open upwardly directed entry to allow bubbles to disengage from the slurry. This means that the flow of particles and fluid received into the first outlet does not contain a significant amount of gas, which in turn makes it easier to pump and/or to be given subsequent treatment in the classification apparatus.

In certain embodiments, the wide-mouthed chamber is conical in shape.

In certain embodiments, the chamber mouth faces upward, with its opening facing the interface.

In certain embodiments, the entry of the chamber has a cross-sectional area which is less than half of the cross-sectional area of the vessel at the interface.

In certain embodiments, the froth flotation vessel is of constant diameter D over its height.

In certain embodiments, the entry to the outlet is located at a vertical distance below the interface which is equivalent to about a diameter of the vessel D at the interface.

In an alternative embodiment, the entry to the first outlet is located at a vertical distance below the interface which is equivalent to between 0.5 D to 1.0 D, where D is a diameter of the vessel at the interface.

In an alternative embodiment, the entry to the first outlet is located at a vertical distance below the interface which is equivalent to between 0.25 D to 0.5 D, where D is a diameter of the vessel at the interface.

In an alternative embodiment, the entry to the first outlet is located at a vertical distance below the interface which is equivalent to between 0.05 D to 0.25 D, where D is a diameter of the vessel at the interface.

In certain embodiments, an uppermost region of the vessel is configured to have a region of lower cross-sectional area compared to the remainder of the froth flotation vessel, thereby crowding the rising froth so as to increase the superficial velocity of the selected particles out of the froth flotation vessel.

In certain embodiments, the region of lower cross-sectional area is formed by fitting a narrow neck portion to the uppermost region, for the rising froth to flow through. In one form of this, the narrow neck portion has a gradually tapering diameter. In an alternative arrangement, the region of lower cross-sectional area is formed by locating an inverted cone into an opening of the uppermost region, so as to form at least a partial annular gap therearound, for the rising froth to flow through.

In a seventh aspect, there is provided a method of separation of selected particles from a mixture of particles in a fluid, the method comprising the steps of: subjecting the mixture of particles and fluid to an upward flow of an introduced gas in a froth flotation vessel, to form a froth layer which rises above an interface formed between the froth layer and the mixture of particles and fluid, such that a quantity of the selected particles is conveyed out of the vessel by the froth layer to become a first product of the system; removing a flow of some of the mixture of particles and fluid from the vessel via a first outlet which is arranged with an entry in a region below the interface, the said flow including a quantity of the selected particles which were not conveyed out of the vessel by the froth layer; and removing a flow of some of the mixture of particles and fluid from the vessel via a second outlet which is located in a region of the vessel which is below the first outlet, the said flow including a quantity of the selected particles in a first by-product of the system; wherein the first by-product comprises a relatively higher percentage of solids compared to the flow of particles and fluid in the first outlet.

In certain embodiments, the method further includes the step of controlling the amount of the said flow of particles and fluid from the vessel via the second outlet so as to maintain a physical parameter of the flow through the second outlet.

In certain embodiments, the method further comprises the step of classifying the flow of particles in fluid removed via the first outlet using a classification apparatus to produce (i) a flow of relatively coarser and/or a flow of relatively higher density particles, including a concentrated amount of the selected particles, as a second product of the separation system, and (ii) a separate flow of relatively finer and/or relatively lower density particles which is either directed to return to the vessel, or removed as a second by-product of the separation system.

In certain embodiments, the method further comprises the step of controlling the amount of the said flow of relatively finer particles and/or relatively lower density particles which is directed to return to the vessel, so as to maintain the position of the froth interface at a level where the entry to the first outlet is below the interface. In one form of this, the said step maintains the froth interface at a level where the entry to the first outlet is proximate to the interface.

In certain embodiments, the method further comprises the step of introducing a fresh feed of selected particles in a mixture of particles in a fluid into the flow of relatively finer particles and/or relatively lower density particles which is directed to the vessel.

In certain embodiments, the method further comprises the step of introducing a gas for froth flotation separation into the flow which is directed to the vessel.

In an eighth aspect of the present disclosure, a flotation system is provided in which contact between bubbles and selected particles occurs in a counter-flowing system. The flotation system comprises means to introduce gas bubbles into a suspension of slurry in a vertical column; means to allow gangue particles to settle in the base of the column; means to control a first tailings stream of gangue particles and water from the base of the column to achieve a relatively high solids concentration in said stream; means to create a froth layer of controlled depth at the top of the column; means to withdraw froth from the froth layer to form a first flotation concentrate; means for withdrawing liquid from beneath the froth layer into a classification device to separate relatively finer particles into a first stream that discharges from the classification device as a second tailings stream, and a second stream that discharges as a second flotation concentrate.

For the purposes of the present disclosure, coarse particles are those that are predominantly above the limits of current mechanical flotation technologies, extending to 2 mm for base metal sulphides or other minerals of similar densities, and to 5 mm for low-density materials such as coal. It will be appreciated that it is a purpose of the present separation system is to recover fine and ultrafine particles as well, whose particle sizes extend to the lower limits of the flotation process itself. In the current separation system, the sizes of the bubbles produced in the aeration device should be in the range 0.3 to 3 mm.

Although the disclosure is made with reference to the use of a fluidised bed contactor, a person skilled in the art will appreciate that there are alternative methods of contacting bubbles and particles, to which the present disclosure can also be applied. Thus known apparatus for the separation of hydrophobic particles by froth flotation can readily be adapted to produce two flotation concentrates and at least one tailings stream.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments which will be described.

DETAILED DESCRIPTION

Figure 1:
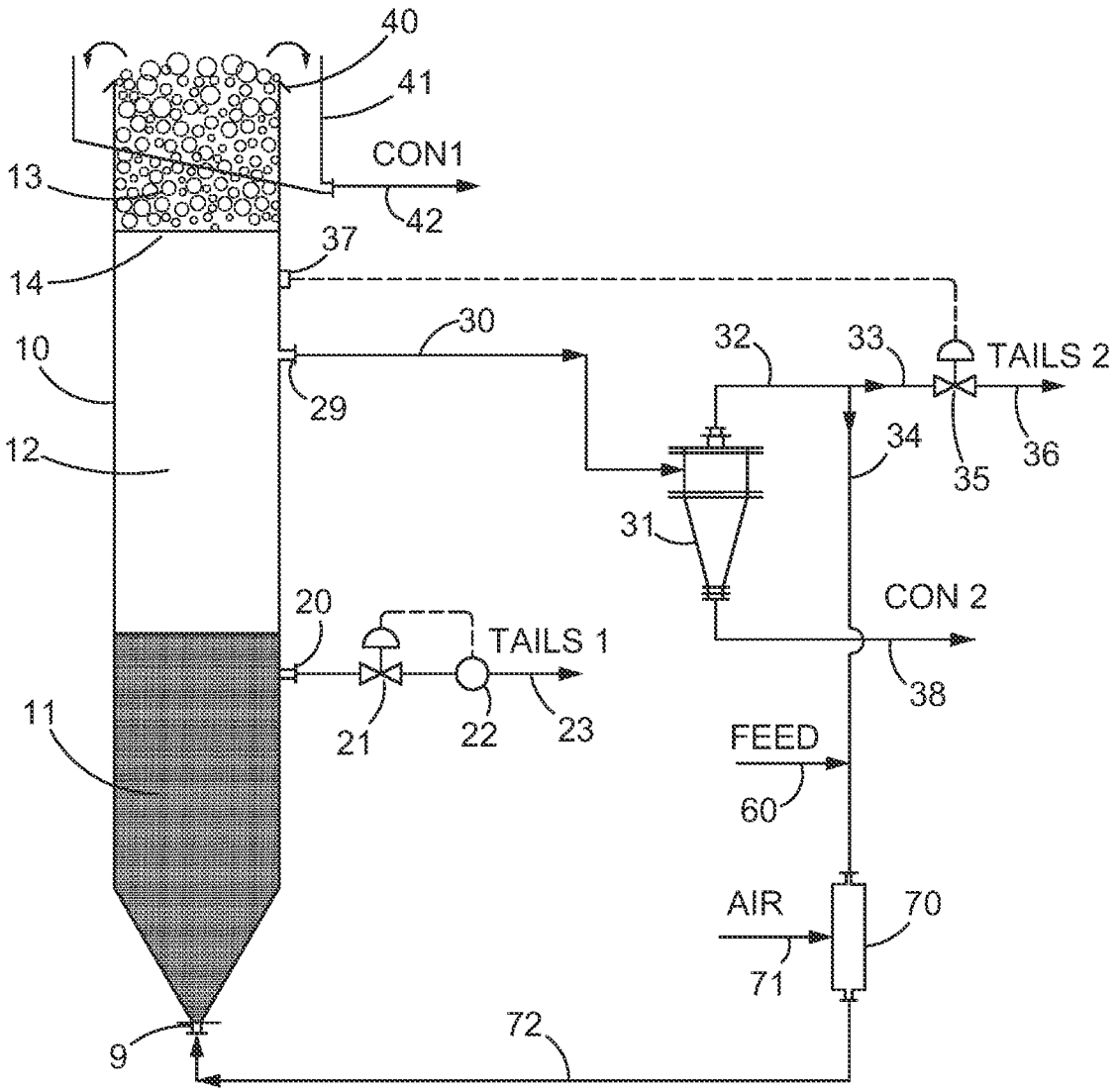
FIG. 1 is a schematic elevation of a separation system according to one embodiment of the present disclosure.

The following description is with reference to the drawings, which should be considered in all respects as illustrative and non-restrictive. In the drawings, corresponding features within the same embodiment or common to different embodiments have been given the same reference numerals.

FIG. 1 shows a first embodiment of a flotation separation system 1 which comprises a froth flotation vessel in the form of a column 10, an aerated slurry inlet port 9 located at the lowermost point of the column 10; a first tailings (or by-product) outlet in the form of a discharge port 20 through which a first final tailings (or "tails") stream is discharged from the column 10; and an outlet in the form of a discharge port 29 which receives a particle and fluid slurry from the column 10, and through which the slurry flows to a classification system 31. The base of the column 10 is conveniently of the shape of an inverted cone 7. At the top end of the column is a lip 40, and a launder 41 which is configured to receive product in the form of froth discharging over the lip 40 from the column 10, and to deliver the froth through a discharge line 42 as a first concentrate CON 1 of the separation system.

For convenience, it will be assumed that the flotation vessel is a column with rotational symmetry about the vertical axis, although columns of square or rectangular section may be used. The liquid feed containing the particles to be separated by flotation is prepared and conditioned with appropriate collector and frother reagents prior to entering the vessel or column 10. Relatively coarse particles in the feed liquid settle in the column, while relatively finer particles may rise. The liquid in the column is rising at a velocity that is sufficient to fluidize a bed of relatively coarse particles in the bottom of column 10.

The flotation column 10 comprises three operational zones: in a lower part, a fluidised bed contact zone 11; in the central part a settling zone 12; and in the top or upper part, a froth zone 13. In the contact zone 11, the flowrate of slurry entering the inlet port 9 is sufficiently high to hydraulically support a majority of the particles, creating a fluidised bed. The slurry is aerated with small bubbles that rise through the fluidised bed, making contact with hydrophobic particles and lifting them upwards into the separation zone. Bubbles with particles attached continue to rise in the separation zone, and any hydrophilic particles that may have been entrained in the wakes of the rising bubbles have an opportunity to fall out of the wakes and return to the fluidised bed. Bubbles with particles attached continue to rise through the separation zone into the froth zone or layer 13. Between the separation and froth zones there is a marked change in the density of the fluid. The density of the slurry in the separation zone underlying the froth is relatively high, since it contains a relatively low proportion of bubbles, while the froth zone has a relatively high proportion of bubbles, and accordingly has a relatively low density. The region between the froth and the underlying pulp or slurry is known as the froth-pulp transition zone, or interface 14. The bubbles rise in the froth zone, because of the continual arrival of new bubbles from below. Froth that is generated by the continual stream of bubbles rising in the column flows over the lip 40 of the column 10 into the launder 41, carrying the attached, selected hydrophobic particles, discharges as the first product concentrate CON 1 from the column through the conduit line 42.

At a level near the top of the fluidised bed, water and particles flow through an outlet in the form of a port 20, under the control of a valve 21 that is actuated by a sensing device 22, to discharge as a first tailings stream through the conduit line 23. The control parameter detected by the sensing device 22 is selected to suit the particular circumstances of the operation. For example, it could measure the percent solids, the density of the solids and/or the mass flowrate of the slurry or the solids in the slurry, as appropriate. The value of the selected parameter measured by the sensing device 22 is converted to a signal that operates the control valve 21 so as to maintain that parameter at a stipulated value.

Figure 1A:
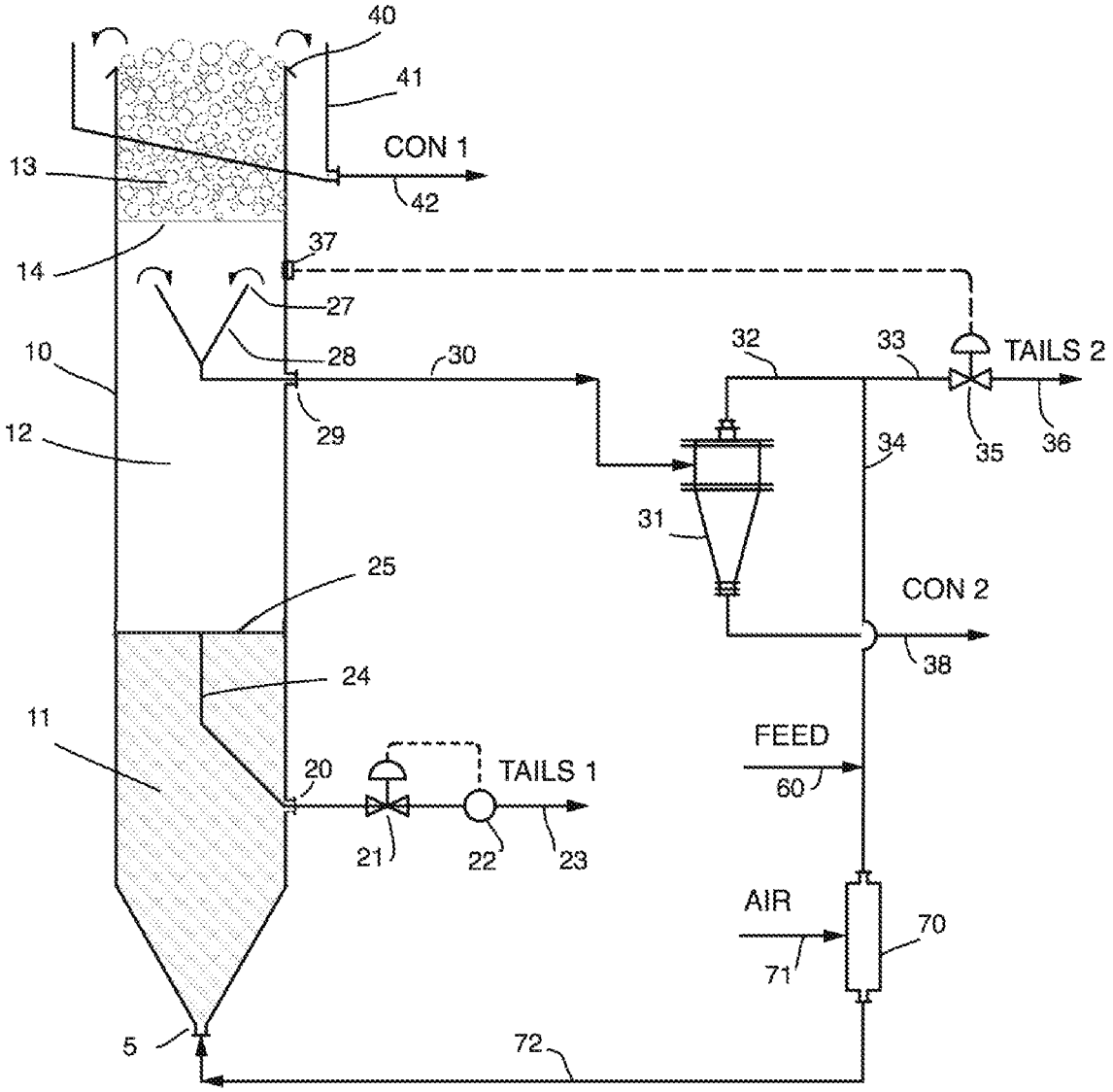
FIG. 1A is a schematic elevation of a separation system according to another embodiment of the present disclosure.

In some applications, it is desirable to control the level of the top of the fluidised bed contact zone 11 in the column. One way of achieving this is shown in FIG. 1A. A vertically oriented conduit 24 having a per-determined vertical height, is located at about the vertical centreline of the column 10 such that an upwardly facing open end of the conduit 24 is positioned at the desired level of an interface 25 which forms between the fluidised bed contact zone 11 and the settling zone 12 thereabove. The conduit 24 passes downward into the contact zone 11 for a portion of its length, and is then angled toward a side wall of the column 10 so as to pass through an outlet in the column wall in form of a port 20. In use, the flow of material through the conduit 24 is under the control of a valve 21 that is actuated by a sensing device 22, to discharge the said material as a first tailings stream through the conduit line 23 (TAILS1). The control parameter detected by the sensing device 22 is selected to suit the particular circumstances of the operation. For example, it could measure the percent solids, the density of the slurry, and/or the mass flowrate of the slurry or that of the solids in the slurry, as appropriate. The value of the selected parameter measured by the sensing device 22 is converted into a signal that operates the control valve 21 so as to maintain that parameter at a stipulated value. In further embodiments, the vertically-oriented conduit 24 can be of adjustable height, and need not be in a centre region of the fluidised bed contact zone 11. In further embodiments, the outlet in the form of port 20 can be located at other convenient positions along the wall of the column 10.

Under the influence of the liquid rising in the fluidised bed contact zone 11, relatively finer particles will be elutriated from the bed and pass upwards into the settling zone 12. Thus in a continuous operation the bed itself will consist of relatively coarser particles and these will constitute the majority of particles in the first tailings stream flowing in line 23. Rising out of the fluidised bed is a stream consisting mainly of water with elutriated relatively finer particles in suspension and bubble-particle aggregates. The aggregates may consist of single bubbles and single particles, single bubbles whose surfaces are partially or completely covered with a layer of particles, or clusters. Clusters consist of multiplicities of bubbles and particles, and have been described by Ata and Jameson (The formation of bubble clusters in flotation cells, Int J Miner Process 76(1-2), 123-139, 2005.) The clusters in this referenced paper were observed in relatively turbulent mechanical cells, and the size and concentration of such clusters is known to be dependent on the intensity of the turbulence in the cell. It would be expected that in the fluidised bed cell, which is relatively quiescent, the size and number of the clusters would be higher than in previous technologies.

The buoyancy or net upward gravitational force on a cluster of particles and bubbles is given by:

$$\text{Net upward force}=V_b g(\rho_L-\rho_g-V_p g(\rho_p-\rho_L)$$

where $V_b$, $V_p$ are the volumes of the bubbles and particles in the cluster, and $\rho_g$, $\rho_L$, $\rho_p$ are the densities of the gas, the liquid and the particles respectively. The upward force can be positive if the volume of the gas is sufficiently high, but it can be appreciated that if the ratio of the volumes of the particles to that of the bubbles is too high, the net upward force can be zero or negative. Where there are many interactions between bubbles and particles simultaneously, a fraction of the clusters will have slightly positive upward buoyancy force, so that they can rise to the top of the settling zone 12 but may lack the buoyancy to force their way into the froth zone 13.

Clusters of low net buoyancy gather at the top of the settling zone 12, surrounded by a suspension of relatively finer particles that have elutriated from the fluidised bed, together with hydrophobic selected particles attached to bubbles that may rise into the froth. An outlet in the form of an exit port 29 and a transfer conduit line 30 are provided, through which slurry with bubble-particle aggregates including clusters may be transported to the classification system or device, which in this embodiment is a hydrocyclone 31, as shown in FIGS. 1 and 1A.

One of the exit streams classified by the hydrocyclone 31 discharges through the conduit 32 containing the relatively finer particles. Conduit 32 splits into two branches 33 and 34. The slurry flowing in conduit 33 passes through a control valve 35 and discharges from the system as a second tailings by-product stream through a discharge conduit 36 (TAILS 2). The control valve 35 regulates the flow of the second tailings stream, so as to maintain the level of the froth-pulp interface 14 in the flotation column 10 at a pre-determined level above the exit port 29. In an alternative arrangement, instead of using a control valve to relate the flow of the second tailings stream in the discharge conduit 36, a variable speed pump and controller can be used to control the TAILS 2 flow, and therefore the quantity of slurry material which is recycled or returned to the flotation cell via the conduit 34. There are a number of methods or devices for measuring the interface position, including float gauges, and differential pressure systems that measure the pressures above and below the interface. In the example shown here, a wall-mounted pressure gauge 37 is used. The signal from the gauge is converted into instructions that are transmitted to the control valve 35, which responds accordingly to maintain the interface level 14 at the desired position.

The control systems described hereinabove, as well as in any of the forthcoming embodiments in FIGS. 2, 2A, 3, 3A and 4, ensure that the interface 14 is maintained at the desired operational position so that the exit port 29 is located in a region proximate to, but below, the interface 14. In one embodiment, the exit port 29 is located at a vertical distance below the interface 14 which is equivalent to about one diameter of the column 10 at the interface. In further embodiments, the exit port 29 is located at a vertical distance below the interface 14 which is equivalent to: between 0.5 D to 1.0 D; or between 0.25 D to 0.5 D; or between 0.05 D to 0.25 D, in each case where D is a diameter of the vessel at the interface. The selected proximity of the interface 14 and the exit port 29 is not arbitrary, and will depend on a number of factors to do with the nature of the particulate slurry being subjected to separation, such as particle size, specific gravity, the hydrophobicity of the selected particles, and pulp density of the slurry, An underflow stream carrying relatively coarse hydrophobic particles from the hydrocyclone 31 discharges through the line 38 as a second flotation concentrate CON 2.

The second conduit 34 carries overflow slurry of relatively fine particles from the hydrocyclone that mixes with a stream of new feed material in a supply conduit 60. The mixture flows to an in-line aeration device 70. In the aerator device 70, gas enters through a supply line 71 and is dispersed into relatively fine bubbles that collide with hydrophobic particles in the feed line 60, and with any hydrophobic particles that may be contained in the slurry from the overflow line 34. The aerated mixture is recycled back to the base of the fluidised bed, entering through the port 9. The aeration device 70 is configured to subject the gas-liquid mixture flowing through it to a relatively high energy dissipation rate, that is favourable to the generation of bubbles of the preferred size, and also to the capture of relatively finer hydrophobic particles in the suspension. Air can be introduced to the slurry in bubble form, or even in a jet form, but broken up into the slurry flow via a static in-line mixer device, for example. The high-energy conditions in the aerator may lead to detachment of relatively coarser particles in the slurry, but such particles will be collected in the fluidised bed contact zone 11 in the column 10.

The purpose of the classification device 31 is to separate a stream of particles in suspension into two or more fractions on the basis of their size or density or a combination of the two. Preferably, the classification device should be able to deliver a first concentrate that consists mainly of the valuable mineral to be separated from the ore. Devices that separate on the basis of size alone are exemplified by various types of screen, such as sieve bends, vibrating screen decks, and high-speed vibratory screens. Hydrocyclones or other devices that utilise centrifugal forces such as centrifuges are widely used to separate on the basis of size alone when the solids are of the same density, but if the densities of the particles are different, small high-density particles will appear in the same product stream as larger particles of lower density. Another general class consists of devices that work on the principle of gravity, and include spirals, tables, teeter beds and the reflux classifier. Any of these classification devices could be used in the present separation system, taking into account the physical properties of the particulate solids to be separated.

It will be appreciated that because there are at least two tailings streams discharging from the separation system, it is possible to control the solids fraction in the first tailings stream (TAILS 1), so that it needs no further dewatering in a downstream thickener, for example. The present disclosure will therefore lead to reduced capital and operating costs for a minerals processing concentrator or coal preparation plant. The excess water removed from the first tailings stream leaves the separation system via the concentrate streams (CON 1 and CON 2) in the conduit lines 42 and 38, or via the second tails stream (TAILS 2) in the conduit line 36.

It will be appreciated by a person skilled in the art that the point at which the new feed enters the flotation system may differ from that shown in FIG. 1. Thus in other embodiments, the feed could be introduced into the fluidised bed contact zone 11 or the settling zone 12.

In the embodiment shown in FIG. 1, bubbles are introduced into the aerator 70 in a recycle conduit 34. It will be understood that bubbles can be introduced into the slurry in other points in the system. Thus, in another embodiment, bubbles are introduced through a gas sparger system that is placed in the settling zone 12 in the column 10, and in yet another embodiment the gas sparger system is immersed in the fluidised bed contact zone 11.

The flotation cell 10 has been shown in FIG. 1 as a vertical column configured to create a fluidised bed of particles in its base. It will be appreciated that it is not essential for a fluidised bed to exist, and the embodiment shown in FIG. 1 leading to the discharge of two or more tailings and concentrate streams can also be implemented in other forms of flotation cell, such as columns and mechanical cells.

In the embodiment depicted in FIG. 1, liquid rises in the column 10 along with bubbles carrying selected particles, which pass into the froth layer 13, along with some entrained liquid. Most of the liquid rising in the column 10 travels via the outlet exit port 29 through the transfer conduit line 30 to the classification device 31. In some circumstances, particularly when the volumetric flow-rate of air bubbles rising in the column 10 is high, a significant number of bubbles are entrained in the transfer conduit line 30, and these bubbles can interfere with the proper operation of the classification device 31.

Figure 2:
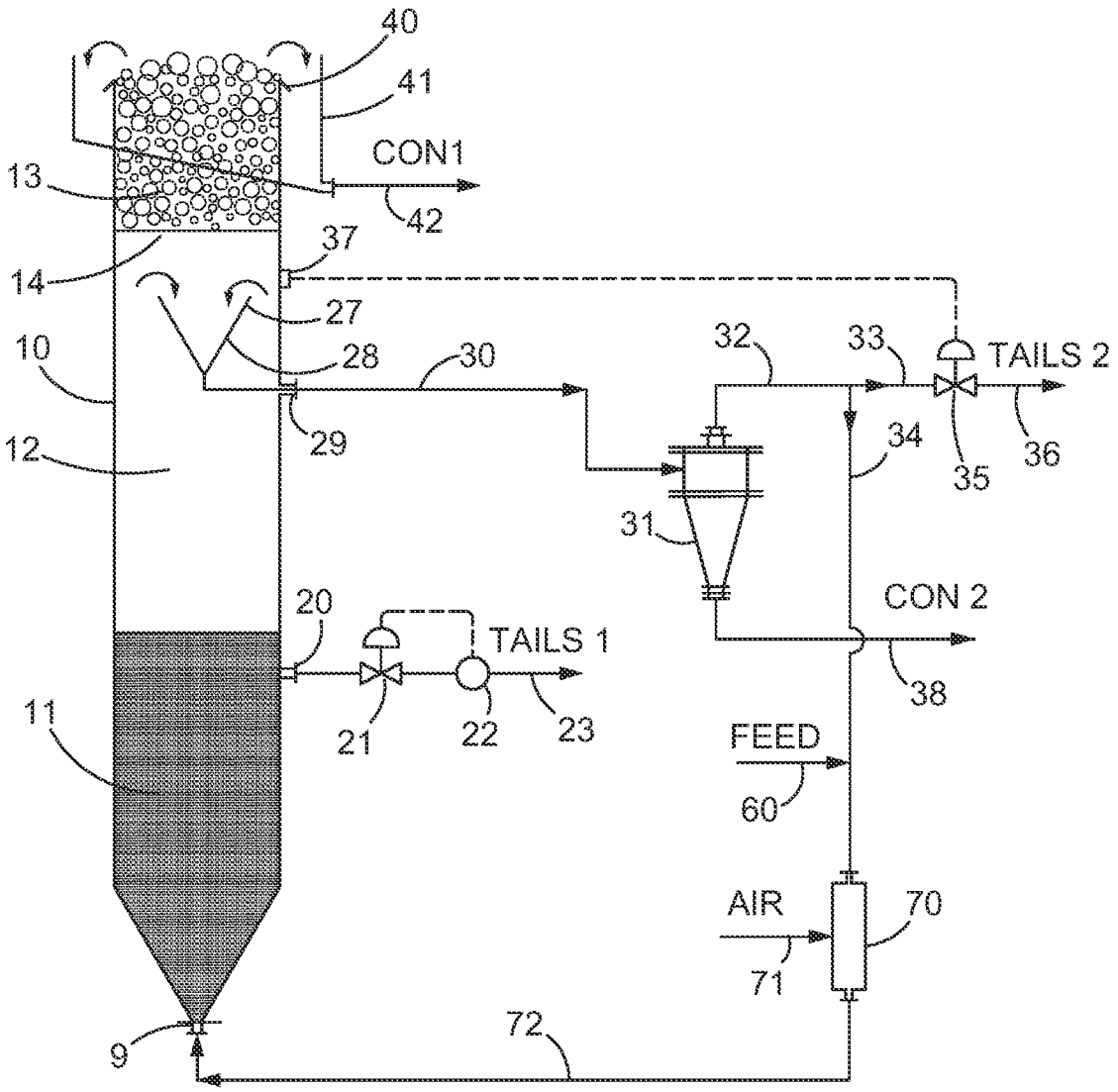
FIG. 2 is a schematic elevation of a separation system according to another embodiment of the present disclosure.

Surprisingly, it has been found that bubble entrainment can be reduced or eliminated by the provision of a separation chamber associated with the outlet in the form of the exit port 29. In some embodiments, the separation chamber comprises an open-topped collection chamber. In the embodiment of FIG. 2, the separation chamber takes the form of a disengagement chamber 28 that can conveniently be constructed in the form of an inverted cone. The wide mouth open region of the inverted cone is oriented away from the rising flow of bubbles in the column 10, and the mouth, defined by the circumferential lip 27 is located proximate to, but below the interface 14. In this second embodiment, liquid rising in the column 10 passes over the lip 27 and into the disengagement chamber 28. The cross-sectional area of the chamber is chosen so that the downwards superficial velocity of the liquid in the chamber is less than that of the majority of the bubbles rising in the column 10. Accordingly, most of the bubbles will disengage and rise under the influence of gravity into the froth layer 13, while the liquid substantially free of bubbles along with particulate solids discharges through the transfer conduit line 30 to the classification device 31. Any bubble-particle clusters that have low effective buoyancy will be entrained in the downflowing liquid in the collection chamber and removed from the column. In the absence of a collection chamber, such clusters may burst, so that the particles that have been carried to the top of the liquid in the column 10 may fall back into the fluidised bed 11. This drawback is overcome by the introduction of the collection chamber 28. A further beneficial effect is that particles that may disengage from the froth, so-called drop-back particles, will fall into the open top of the disengagement chamber 28 and be transferred to the classification device 31. In one example, the chamber 28 has a cross-sectional area which is less than half of the cross-sectional area of the vessel at the interface.

Figure 2A:
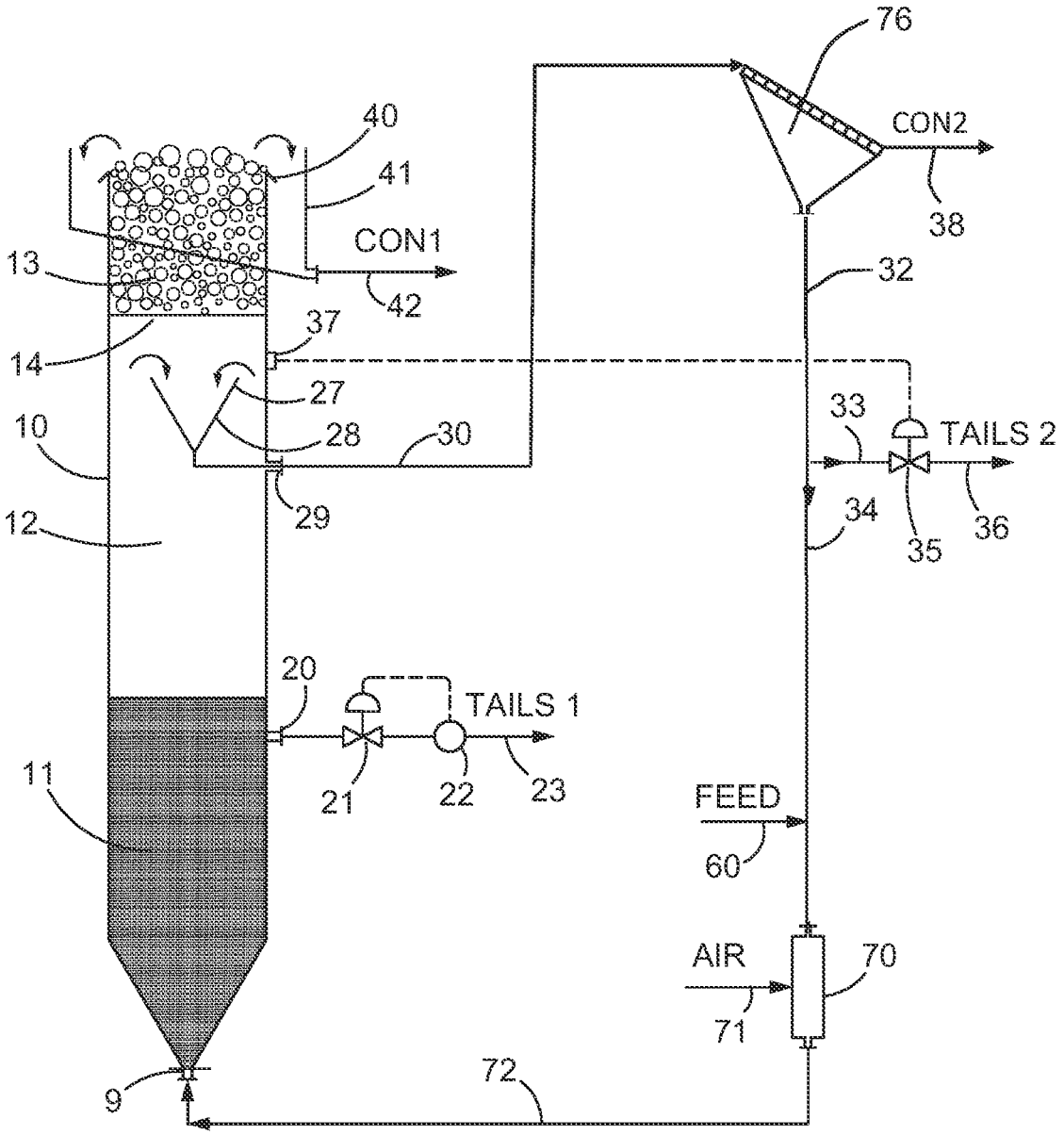
FIG. 2A is a schematic elevation of a separation system according to another embodiment of the present disclosure.

Referring now to FIG. 2A, this embodiment is in all respects similar to the embodiment shown and described already in relation to FIG. 2, except it shows a further embodiment of a classification system or device, which is in the form of a sloping deck, vibrating screen 31. One of the exit streams classified by the screen 31 (that is, the screen underflow solids and liquids) discharges through the conduit 32 containing the relatively finer particles. An overflow stream from the screen deck carrying relatively coarse hydrophobic particles discharges through the line 38 as a second flotation concentrate CON2.

Figure 3:
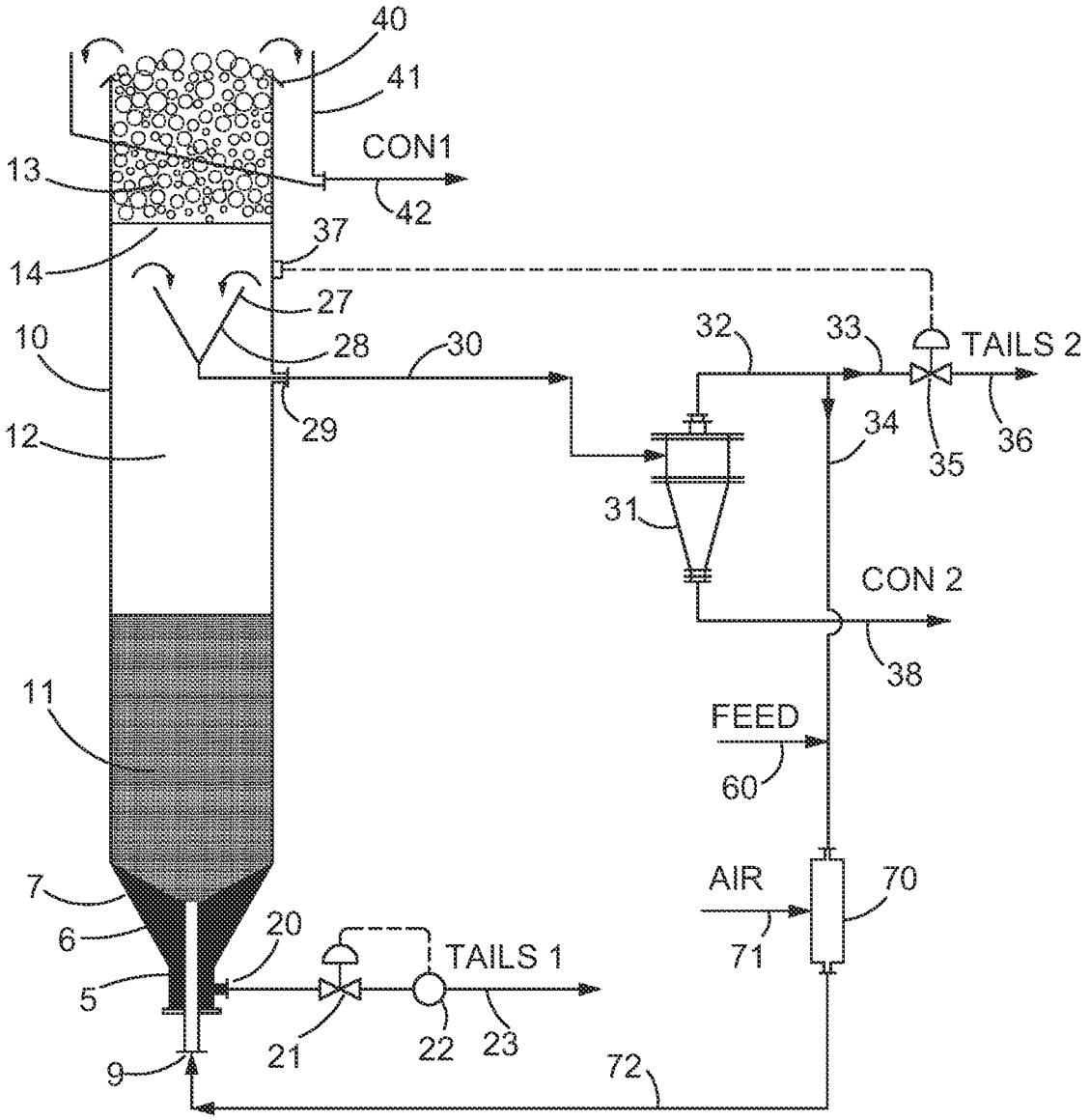
FIG. 3 is a schematic elevation of a separation system according to a further embodiment of the present disclosure.

FIG. 3 shows another embodiment, which can be used when the feed material contains dense gangue particles that may segregate in the fluidised bed. If such particles are allowed to accumulate they may interfere with the proper operation of the fluidised bed. A solution is provided by the introduction of the aerated stream of new feed and recycled particles in the line 72, into the base of the fluidised bed through an entry port 9, that is configured to include a standpipe 5 that extends part-way into the column 10. The entering particulate slurry leaves the end 6 of the standpipe 5 in the form of a jet in a substantially vertical direction, and as it rises in the column 10, it diffuses laterally and axially, creating a fluidised bed 11. Particles that cannot be supported by the upwards motion of the fluidising liquid fall under gravity to the downwardly sloping sides 7 of the base of the column 10 and discharge through the tails exit port 20 into a transfer line in which the flow is controlled by a valve 21. The control valve 21 responds to signals generated by the sensor 22, so as to maintain the appropriate properties of the first tails stream discharging through the line 23. The control parameters determined and maintained by the sensor 22 and the control valve 21 could include the slurry mass flow rate, the solids flow rate, the fraction of solids in the discharge stream 23 or other appropriate measurements dictated by the characteristics of the ore being processed.

Figure 3A:
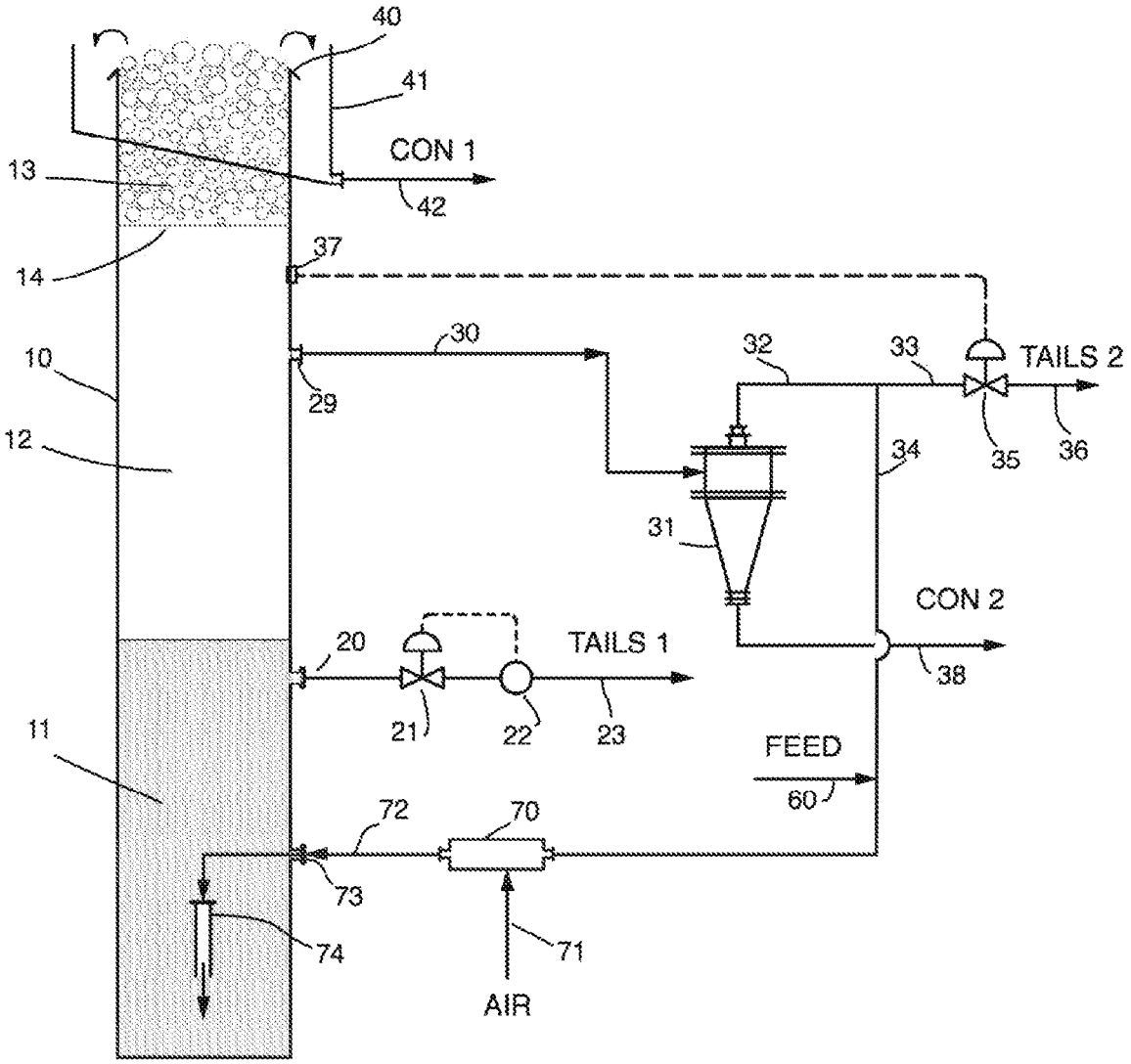
FIG. 3A is a schematic elevation of a separation system according to a further embodiment of the present disclosure.

FIG. 3A shows another embodiment which can be used when it is necessary to minimise the overall height of the flotation cell, achieved by eliminating the downwardly facing sides of the column, so that the base of the column is essentially horizontal. The aerated stream of particles and fluid is introduced into the lower region of the flotation cell via the conduit 72, and into the fluidised bed region through an entry in the form of an inlet port 73, which is in turn connected to a downwardly facing, vertically-oriented, cylindrical cross-section duct 74 which is located centrally in the column 10. The duct 74 discharges the aerated stream of particles and fluid downwardly toward the base of the fluidised bed. In one example, the downward velocity of the mixture of particles and air bubbles issuing from the downwardly facing duct 74 is in the range of between 5 to 25 metres per second.

In the embodiments shown in FIGS. 1, 1A, 2, 2A, 3 and 3A, fresh feed of selected particles in a mixture of particles in a fluid, combined with a flow of gas introduced at the aerator device 70, is introduced via an entry port in the form of inlet port 9 (in FIGS. 1, 1A, 2, 2A and 3), or via the inlet port 73 (in FIG. 3A), to form a part of the fluidised bed contact zone 11 of particles suspended in liquid in the lowermost region, through which bubbles of gas flow upwardly in the column 10. In these examples, the inlet port 9, 73 is spaced apart sufficiently from the outlet from the fluidised bed region in the form of the tailings exit port 20. These entry and outlet ports are located near the uppermost and lowermost ends of the fluidised bed contact zone 11 (as shown in FIGS. 1, 2, 2A, 3A), and in the case of FIG. 1A the entry to the outlet port is located at the top of the fluidised bed contact zone 11, so that the fresh feed entering the vessel is not placed in immediate fluid communication with a by-product tailings leaving the vessel via the outlet port, so there is no 'short-circuiting' of fresh feed straight out to a tailings output, and there is a chance for bubbles and particles to rise out of the fluidised bed contact zone 11. Similarly, as shown in FIG. 3, the entry port is a standpipe 5 which extends midway into the fluidised bed contact zone 11 of the flotation column 10 and away from the base of the column 10 and the discharge through the tails exit port 20 to prevent short-circuiting flow out of the contact zone 11.

Figure 4:
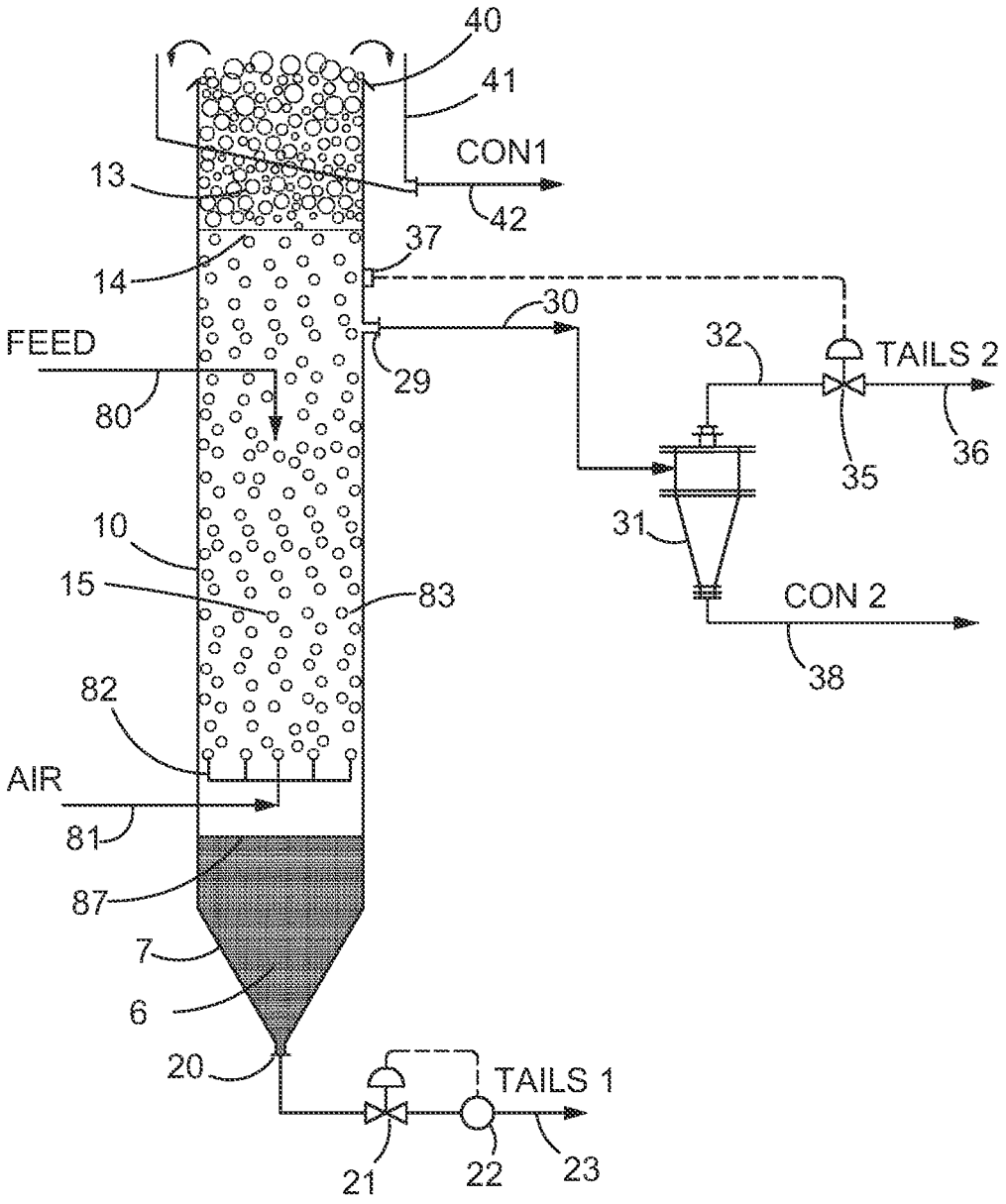
FIG. 4 is a schematic elevation showing a separation system according to yet another embodiment of the present disclosure.

FIG. 4 shows another embodiment, which is applicable to froth flotation columns of conventional design, which operate without a fluidised bed. In the embodiment shown in FIG. 4, a supply of appropriately conditioned new feed slurry enters through a line 80, discharging into the column 10. In this embodiment, the column 10 comprises three operational zones: in an upper part, a froth zone 13; in a central part, a collection zone 15 where hydrophobic particles are collected by bubbles; and in a lower part, a bed of settled solids 16.

A supply of gas is introduced into the column through a line 81, and is distributed to a sparger system 82, which disperses the gas into many small bubbles 83 of a diameter suitable for flotation, typically in the diameter of 0.3 to 3 mm. The bubbles rise under gravity and pass through the slurry in the column, collecting hydrophobic particles as they do so. The bubbles rise through the pulp-froth interface 14 into the froth layer 13, carrying attached hydrophobic particles and water. The froth continues to rise upwards and passes over the lip 40 of the flotation column 10 and into a launder 41, from which it discharges through the duct 42 as a first flotation concentrate CON1.

A first part of the feed that has been introduced through the line 80 descends in the column 10, towards the discharge port 20. The downward velocity of the slurry is sufficiently low to permit gas bubbles to rise upwards, into the froth layer. The feed slurry contains relatively coarse gangue particles that may settle relative to the liquid, and the flotation system in the embodiment shown in FIG. 4 is configured to allow a layer of settled particles to form in the lower part of the column 10. The settled solids accompanied by water discharge through a port 20, under the control of a valve 21 that is actuated by a sensing device 22, to discharge as a first tailings stream through the line 23. The sensing device 22 can conveniently be chosen to measure the percent solids in the first tailings stream, and transmit a signal to the control valve 21 so as to maintain the percent solids at a chosen value. Other control parameters may also be used such as the mass flowrate of the first tailings stream, or of the solids in the first tailings stream.

With reference to FIG. 4, a second stream of slurry containing suspended relatively finer particles, together with bubbles with attached selected hydrophobic particles, rises towards the top of the collection zone 15. At or near the top of the collection zone, beneath the froth-pulp interface 14, an outlet in the form of an exit port 29 and a transfer conduit line 30 are provided through which slurry with particles, bubbles, aggregates of hydrophobic particles and bubbles, and clusters may be transported to the classification system or device, which in this embodiment is a hydrocyclone 31, as shown in FIG. 1.

One of the exit streams classified by the hydrocyclone 31 discharges through the conduit 32 containing the relatively finer particles. The slurry flowing in conduit 32 passes through a control valve 35 and discharges from the system as a second tailings by-product stream through a discharge conduit 36 (TAILS 2). The control valve 35 regulates the flow of the second tailings stream, so as to maintain the level of the froth-pulp interface 14 in the flotation column 10 at a pre-determined level above the exit port 29. In an alternative arrangement, instead of using a control valve to relate the flow of the second tailings stream in the discharge conduit 36, a variable speed pump and controller can be used to control the TAILS 2 flow, and therefore the quantity of slurry material which is recycled or returned to the flotation cell via the conduit 34. There are a number of methods or devices for measuring the interface position, including float gauges, and differential pressure systems that measure the pressures above and below the interface. In the example shown here, a wall-mounted pressure gauge 37 is used. The signal from the gauge is converted into instructions that are transmitted to the control valve 35, which responds accordingly to maintain the interface level 14 at the desired position.

The control systems described hereinabove, ensure that the interface 14 is maintained at the desired operational position so that the exit port 29 is located in a region proximate to, but below, the interface 14. In one embodiment, the exit port 29 is located at a vertical distance below the interface 14 which is equivalent to about one diameter of the column 10 at the interface. In further embodiments, the exit port 29 is located at a vertical distance below the interface 14 which is equivalent to: between 0.5 D to 1.0 D; or between 0.25 D to 0.5 D; or between 0.05 D to 0.25 D, in each case where D is a diameter of the vessel at the interface.

An underflow stream carrying relatively coarse hydrophobic particles from the hydrocyclone 31 discharges through the line 38 as a second flotation concentrate CON2.

The configuration shown in FIG. 4 can provide significant advantages when compared to the operation of conventional froth flotation columns. In conventional flotation column operations, a minor fraction of the water in the new feed passes over the lip of the column and into a launder, from which it discharges as a flotation concentrate. The remainder of the water and non-floating particles discharge through an exit at the base of the column, as the tails. In effect, there is no control of the percent solids in the tails, which in many operations, is quite close to that of the new feed, generally in the range 20 to 45% in base metal operations. In the embodiment shown in FIG. 4 however, the flow rates in the two tailings streams can be balanced to achieve two separate aims; first, to maintain the level of the froth-pulp interface at a desired position, and second, to produce a tailings stream that requires no further de-watering prior to discharge from a concentrator. Thus the percent solids in the first tailings stream could be raised to at least as high as 55 to 65%.

In practical operations, occasions will arise where the new feed to the configuration shown in FIG. 4 contains no coarse particles that could be recovered as concentrate in the classification device 31. It will be appreciated by a person skilled in the art, that there are substantial advantages still to be achieved by dispensing with the classification device and the second concentrate stream altogether, while maintaining the two tailings streams and the concentrate recovered from the froth zone. In such an arrangement, the flotation column could still be operated to achieve the twin aims of controlling the position of the froth-pulp interface and the percent solids in the first tailings stream.

Figure 5:
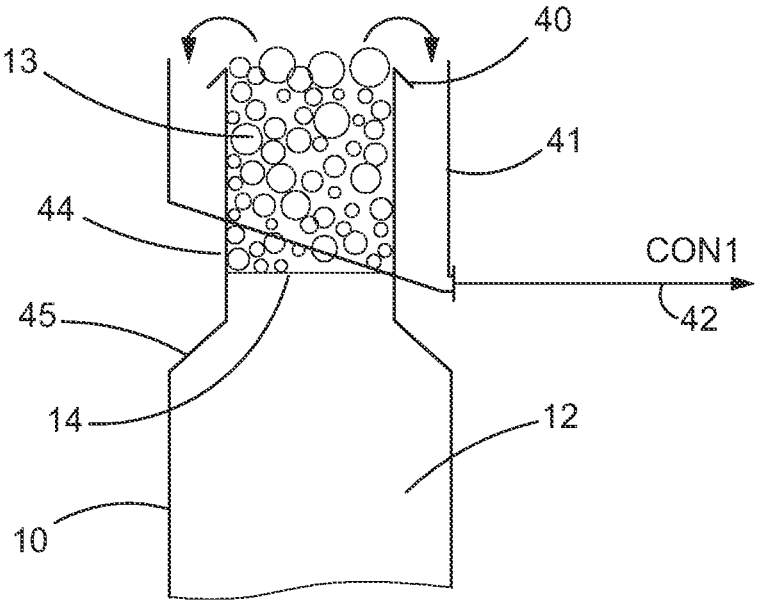
FIG. 5 is a schematic elevation showing a modification to a flotation vessel which is a part of the separation system shown in FIGS. 1, 1A, 2, 2A, 3 and 4.
Figure 6:
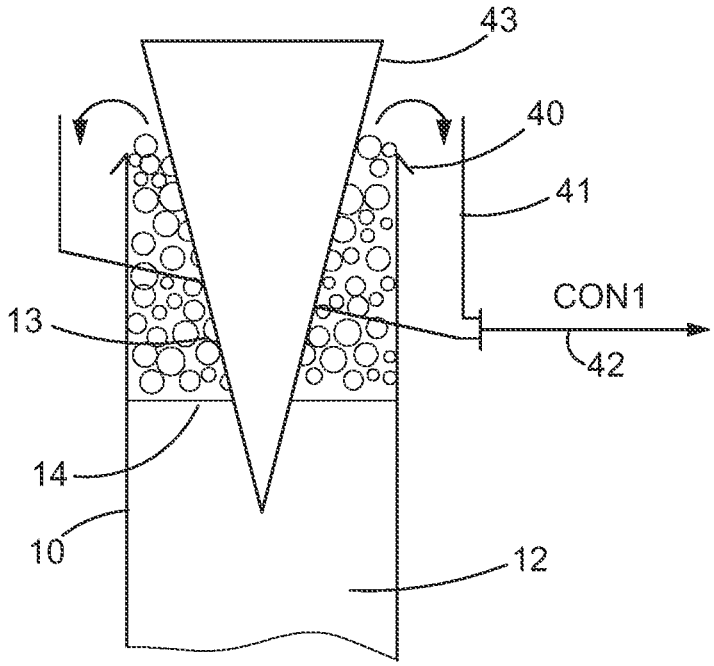
FIG. 6 is a schematic elevation showing another modification to a flotation vessel which is a part of the separation system shown in FIGS. 1, 1A, 2, 2A, 3 and 4.

In the embodiments depicted in FIGS. 1, 1A, 2, 2A, 3, 3A and 4, the column 10 is shown as a cylindrical column with rotational symmetry about the vertical axis. In such an arrangement, the cross-sectional area is independent of height, so the rise velocity of the froth will be constant. The superficial velocity of the gas rising in the froth is an important parameter that must be taken into account in the design of flotation columns. It is known that if the gas superficial velocity is relatively low, coarse particles may move downwardly relative in the froth, and may return to the pulp zone 12 below the froth. When the cross-sectional area is constant, the gas superficial velocity must also be constant. A person skilled in the art will recognise that the cross-sectional area of the column in the froth zone may be reduced with advantage, to increase the gas superficial velocity, and thereby to improve the recovery of coarse particles. The area reduction can be accomplished by a number of means. Thus, FIG. 5 shows an embodiment in which a first column 10 is surmounted by a second column 44 of smaller diameter, the two columns being connected by a conical reducer 45. FIG. 6 shows another embodiment in which the column 10 is of constant cross-sectional area, and a body 43 of the shape of an inverted cone is inserted so that as the gas rises in the device, the superficial velocity of the froth increases as it approaches the lip 40, thereby assisting coarse particles in the froth to continue to rise upwardly in the column.

It will further be appreciated that any of the features in the embodiments of the present disclosure can be combined together and are not necessarily applied in isolation from each other. For example, the feature of the disengagement chamber 28 in FIG. 2. can be combined with the feature of standpipe 5 and associated tailings exit port 20 in FIG. 3. Similar combinations of two or more features from the above described embodiments of the separation system and separation apparatus can be considered to fall within the present disclosure.

Experimental Results

Experimental results have been produced by the inventor using the new equipment configuration disclosed herein, to assess whether there are any metallurgically beneficial outcomes during the operation of the separation system and apparatus.

A froth flotation system operating was constructed in accordance with the embodiment shown in FIG. 2A. The system was operated in batch mode (that is, without the addition of fresh feed into conduit 60). A feed material consisting of coal and ash particles up to 2 mm in diameter, was placed in the flotation column. Such a feed size distribution is very wide for coal flotation separation, where normally the ore material is crushed to a top size of no more than 0.5 mm (500 micrometers).

Diesel oil was used as a collector reagent (dosage: 1 kg/tonne of feed solids) and MIBC (methyl isobutyl carbinol) was used as a frother reagent (dosage: 20 ppm in the water). The gas used in the flotation column was air, with a superficial velocity in the column of 1.5 cm/sec. The superficial velocity of the recycle liquid introduced into the base of the flotation column, calculated in terms of the cross-sectional area of the column, was 1.5 cm/sec. The froth depth maintained in the uppermost portion of the flotation column was 100 mm. A wedge-wire sieve bend was used as the classification system, with a nominal gap size of 0.5 mm. The underflow from the sieve bend was collected and returned to the base of the flotation column as recycle, to maintain the fluidisation in the fluidised bed contact zone. The froth product was designated as CON 1 and the oversize from the sieve bend was collected as CON 2. The flotation time was ten minutes of aeration and recirculation flows.

TABLE 1

Distribution of mass by particle size band

| Screen size, μm | | Mass distribution | | | | |
|---|---|---|---|---|---|---|
| Upper (μm) | Lower (μm) | Feed | Con 1 | Con 2 | Combined Product | Tails |
| 2000 | 1400 | 10.4 | 3.3 | 3.5 | 6.8 | 3.5 |
| 1400 | 1000 | 18.5 | 6.9 | 5.6 | 12.4 | 6.1 |
| 1000 | 710 | 17.9 | 7.4 | 5.8 | 13.2 | 4.7 |
| 710 | 500 | 14.3 | 6.9 | 4.9 | 11.8 | 2.5 |
| 500 | 0 | 38.9 | 24.0 | 6.9 | 31.0 | 7.9 |
| Overall: | | 100.0 | 48.5 | 26.7 | 75.3 | 24.7 |

TABLE 2

Ash in sample, %

| Screen size, μm | | Ash (%) | | | | |
|---|---|---|---|---|---|---|
| Upper (μm) | Lower (μm) | Feed | Con 1 | Con 2 | Combined Product | Tails |
| 2000 | 1400 | 34.6 | 4.5 | 10.5 | 7.5 | 86.9 |
| 1400 | 1000 | 35.1 | 4.9 | 14.8 | 9.4 | 87.7 |
| 1000 | 710 | 33.6 | 7.0 | 23.1 | 14.1 | 88.1 |
| 710 | 500 | 29.6 | 9.8 | 27.4 | 17.1 | 89.4 |
| 500 | 0 | 35.2 | 23.3 | 19.2 | 22.3 | 85.1 |
| Overall: | | 34.0 | 15.0 | 19.5 | 16.6 | 87.0 |

TABLE 3

| Combustibles distribution, combustibles recovery, yield | | | | | | | | |
|---|---|---|---|---|---|---|---|---|
| Screen size, μm | | Combustibles distribution | | | | | | |
| Upper (μm) | Lower (μm) | Feed | Con 1 | Con 2 | Combined Product | Tails | Combustibles recovery, % | Yield, % |
| 2000 | 1400 | 10.3 | 4.8 | 4.8 | 9.6 | 0.7 | 93.2 | 65.9 |
| 1400 | 1000 | 18.2 | 9.9 | 7.2 | 17.1 | 1.1 | 93.8 | 67.1 |
| 1000 | 710 | 18.0 | 10.4 | 6.8 | 17.2 | 0.9 | 95.3 | 73.7 |
| 710 | 500 | 15.3 | 9.5 | 5.4 | 14.9 | 0.4 | 97.4 | 82.8 |
| 500 | 0 | 38.2 | 27.9 | 8.5 | 36.4 | 1.8 | 95.3 | 79.6 |
| Overall: | | 100.0 | 62.5 | 32.6 | 95.1 | 4.9 | 95.1 | 75.3 |

Table 1 shows the distribution of mass in various size fractions in the initial feed, in CON1, in CON2, in the combined CON flows and in the tailings by-product stream (TAILS1). Approximately two-thirds of the concentrate was produced as froth product (CON1), while one third was recovered in the classification system (CON2). Inspection of the size-by-size mass distributions shows that in the finest size fractions, the CON1 stream is predominantly composed of the finest particles, but the particles were split evenly between the two product streams as the particle size increased.

Table 2 shows that overall the ash content of CON2 was higher, which is not unexpected, but only marginally so (15% versus 19.5%). The ash content in the tails (TAILS1) was essentially independent of particle size (typically in the range between 85-90%) averaging 87%. This shows that the separation effected by the system was very cleanly done, over a very large range of particle sizes.

Table 3 shows the distributions and recoveries of the combustible coal matter in the various streams. Overall recoveries were very high across all size ranges (between 93-97%), which demonstrates that even for a very coarse size of particulate feed material, the separation system disclosed herein is a very efficient way of yielding both high recoveries of the valuable solids accompanied by a low ash content in the separated product.

Such a result means that the separation system disclosed herein can provide a user with a way of maximising the performance of a flotation separation stage over much higher than normal particulate sizes, which in turn means lower grinding costs in the preceding ore milling stage, which can offer a significant reduction in operating costs overall to a minerals processing operation.

The inventor has discovered that the use of a separation system of the present disclosure can realise optimum (and stable) operating conditions, and has been found to:

i) promote better flotation separation recovery and yield of selected (value) particles, but at an overall coarser size distribution, thereby avoiding overgrinding of particles;

ii) maximise throughput of product in terms of, for example, tonnage per hour;

iii) produce a tailings stream from a lowermost region of, or fluidised bed zone of, a froth flotation cell, which can be discharged direct to a tailings disposal plant avoiding the need for additional dewatering; and iv) maintain the physical separation process parameters at a stable level.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "top" and "bottom", "upper" and "lower", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The preceding description is provided in relation to several embodiments which may share common characteristics and features. It is to be understood that one or more features of any one embodiment may be combinable with one or more features of the other embodiments. In addition, any single feature or combination of features in any of the embodiments may constitute additional embodiments.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, any inventions which have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realise yet other embodiments. Further, each independent feature or component of any given assembly may constitute an additional embodiment.

The invention claimed is:

1. A separation system for separating selected particles from a mixture of particles in a fluid, the system comprising:

a froth flotation vessel into which in use the mixture of particles and fluid are subjected to an upward flow of an introduced gas to form part of, and to hydraulically support, a fluidized bed of particles suspended in liquid, located in a lowermost region of the vessel;

an aerator device arranged in use for aerating the mixture with the introduced gas, to form a froth layer which rises above an interface formed between the froth layer and the mixture of particles and fluid, such that a quantity of the selected particles is conveyed out of an uppermost region of the vessel by the froth layer to become a product of the system;

a first outlet arranged in use for receiving a flow of some of the mixture of particles and fluid from the vessel including a quantity of the selected particles which were not conveyed out of the vessel by the froth layer, an entry to the first outlet being located in a region below the interface;

a second outlet arranged in use for receiving a flow of some of the mixture of particles and fluid from the fluidized bed, located in the lowermost region of the vessel which is located below the first outlet, the flow comprising a relatively higher percentage of solids compared to the flow of particles and fluid in the first outlet;

wherein the froth flotation vessel has a control system comprising a sensing device for measuring a control parameter, which is connected to a flow control device for controlling at least one of:

the flow of the mixture of particles and fluid passing through the first outlet for which the control parameter is to maintain the position of the interface in the froth flotation vessel in relation to the first outlet; and the flow of the mixture of particles and fluid passing through the second outlet, for which the control parameter is to maintain a physical parameter of the flow at a stipulated value at that depth of the fluidized bed.

2. A separation system as claimed in claim 1, wherein the flow of particles and fluid in the first outlet passes to a classification apparatus to produce a flow of relatively coarser and/or higher density particles and a separate flow of relatively finer and or lower density particles, and the control system is arranged to control one of the said flows from the classification apparatus.

3. A separation system as claimed in claim 2, wherein the control system controls the amount of the said flow of relatively finer particles and/or relatively lower density particles which is directed either to return to the vessel, or to become a second by-product of the separation system.

4. A separation system as claimed in claim 3, wherein the control system controls a valve which directs the said flows.

5. A separation system as claimed in claim 3, wherein the control system controls a speed control of a variable speed pump, to direct the said flows.

6. A separation system as claimed in claim 4, wherein the control system further includes a sensor which senses the position of the interface in the froth flotation vessel in relation to the first outlet.

7. A separation system as claimed in claim 1, wherein the flow of the mixture of particles and fluid passing through the second outlet is controlled by a valve that is actuated by the sensing device which measures a physical parameter of the flow through the second outlet, to produce a signal to control the valve.

8. A separation system as claimed in claim 1, wherein the physical parameter includes one or more of the group comprising: the percentage of particulates in the fluid, the density of the particulates, and the mass flowrate of the particulates in the mixture of particulates in fluid.

9. A separation system as claimed in claim 1, wherein the flow of the mixture of particles and fluid passing through the second outlet forms a first by-product of the separation system.

10. A separation system as claimed in claim 2, wherein the flow of a relatively coarser and/or higher density particles from the classification apparatus includes a concentrated amount of the selected particles, and becomes a second product of the system.

11. A separation system as claimed in 10, wherein the classification apparatus is one or more of the group comprising: a screen, a sieve bend, a vibrating screen deck, a vibratory screen, a hydrocyclone, a spiral, a gravity table, a teeter bed and a reflux classifier.

12. A separation system as claimed in claim 3, wherein fresh feed of selected particles in a mixture of particles in a fluid is introduced in-line into the flow of relatively finer particles and/or relatively lower density particles which is directed to the vessel so that the resulting mixture of particles and fluid can be returned to, and discharged into, a lowermost region of the froth flotation vessel below the first outlet, to form part of, and to hydraulically support, the fluidized bed of particles suspended in liquid.

13. A separation system as claimed in claim 12, wherein gas for froth flotation separation is introduced by the aerator device in-line into the flow of relatively finer particles and/or relatively lower density particles which is directed to the vessel.

14. A separation system as claimed in claim 3, wherein gas for froth flotation separation is introduced by the aerator device in-line into a flow of particles and fluid which is directed to the vessel, so that the resulting aerated mixture of particles and fluid can be returned to, and discharged into, a lowermost region of the froth flotation vessel below the first outlet, to form part of, and to hydraulically support, the fluidized bed of particles suspended in liquid.

15. A separation system as claimed in claim 14, wherein fresh feed of selected particles in a mixture of particles in a fluid is combined with the flow gas for froth flotation separation which is introduced by the aerator device in-line into a flow of particles and fluid which is directed to the vessel.

16. A separation system as claimed in claim 13, wherein the aerated mixture of particles and fluid along with the introduced gas is discharged into the vessel at a location that is spaced apart sufficiently from, and not placed in immediate fluid communication with, a flow of particles and fluid leaving the vessel via the second outlet, so as to prevent short-circuiting of the aerated mixture therewith.

17. A separation system as claimed in claim 16, wherein the aerated mixture of particles and fluid along with the introduced gas is discharged into the vessel at a location near a lower part of the fluidized bed in the vessel, and the second outlet is located near an upper part of the fluidized bed.

18. A separation system as claimed in claim 16, wherein the aerated mixture of particles and fluid along with the introduced gas is discharged into the vessel via a pipe which is arranged to extend midway into the fluidized bed, and the second outlet is located near a lower part of the fluidized bed.

19. A separation system as claimed in claim 16, wherein the aerated stream of particles and fluid is introduced into the fluidized bed in the form of a downwardly-facing, vertically-oriented, cylindrical cross-section pipe conduit which is located within the vessel, and which discharges the aerated stream of particles and fluid in a downward direction towards the base of the fluidized bed.

20. A separation system as claimed in claim 3, wherein fresh feed of selected particles in a mixture of particles in a fluid, and gas for flotation separation, are introduced at separate locations into the uppermost region of the vessel.

21. A separation system as claimed in claim 20, wherein the gas is introduced near a lower part of the uppermost region in the form of bubbles which rise upwardly through the uppermost region to form the froth layer, and the fresh feed is introduced at a relatively higher location in the uppermost region.

22. A separation system as claimed in claim 20, wherein the second outlet is located below a bed of particles which forms at a lowermost region of the froth flotation vessel, and which comprises the first by-product.

23. A separation system as claimed in claim 1, wherein a chamber located within the froth flotation vessel forms a part of the first outlet, the chamber having an entry which is oriented away from the upward flow of introduced gas in the vessel, in use arranged so that said upward flow of gas is separated from the flow of particles and fluid which is received into the first outlet.

24. A separation system as claimed in claim 1, wherein an uppermost region of the froth flotation vessel is configured to have a region of lower cross-sectional area compared to the remainder of the froth flotation vessel, thereby crowding the rising froth so as to increase the superficial velocity of the selected particles out of the froth flotation vessel.

25. A separation system as claimed in claim 5, wherein the control system further includes a sensor which senses the position of the interface in the froth flotation vessel in relation to the first outlet.

26. A separation system as claimed in claim 15, wherein the aerated mixture of particles and fluid along with the introduced gas is discharged into the vessel at a location that is spaced apart sufficiently from, and not placed in immediate fluid communication with, a flow of particles and fluid leaving the vessel via the second outlet, so as to prevent short-circuiting of the aerated mixture therewith.

27. A separation system as claimed in claim 21, wherein the second outlet is located below a bed of particles which forms at a lowermost region of the froth flotation vessel, and which comprises the first by-product.

* * * * *